US006019365A

United States Patent [19]

Matsumura

[11] Patent Number: 6,019,365

[45] Date of Patent: Feb. 1, 2000

[54] SHEET ALIGNMENT DEVICE, AND IMAGE FORMING APPARATUS EQUIPPED WITH THE SAME

[75] Inventor: Takuo Matsumura, Ebina, Japan

[73] Assignee: Fuji Xerox Co., Ltd., Tokyo, Japan

[21] Appl. No.: 08/988,008

[22] Filed: Dec. 10, 1997

[30] Foreign Application Priority Data

Dec. 12, 1996 [JP] Japan ..... 8-331852

[51] Int. Cl.[7] ..... B65H 7/02

[52] U.S. Cl. ..... 271/227; 399/395

[58] Field of Search ..... 271/227, 228; 399/395

[56] References Cited

U.S. PATENT DOCUMENTS

| | | | |
|---|---|---|---|
| 4,685,664 | 8/1987 | Petersdorf | 271/227 |
| 4,855,607 | 8/1989 | Eckl | 271/227 |
| 4,971,304 | 11/1990 | Lofthus | 271/227 |
| 5,219,159 | 6/1993 | Malachowski et al. | 271/228 |
| 5,273,274 | 12/1993 | Thomson et al. | 271/228 |
| 5,697,609 | 12/1997 | Williams et al. | 271/228 |
| 5,794,176 | 8/1998 | Milillo | 271/228 |

FOREIGN PATENT DOCUMENTS

| | | | |
|---|---|---|---|
| 32-90344 | 6/1957 | Japan . | |
| 38-225052 | 9/1963 | Japan . | |
| 59-4552 | 1/1984 | Japan . | |
| 0082255 | 4/1988 | Japan | 271/228 |
| 0127956 | 5/1988 | Japan | 271/227 |
| 0198952 | 8/1990 | Japan | 271/228 |
| B2-3-53219 | 8/1991 | Japan . | |

*Primary Examiner*—H. Grant Skaggs
*Attorney, Agent, or Firm*—Oliff & Berridge, PLC

[57] ABSTRACT

Conveyor rollers 1*a*, 1*b* which are driven by a rotary drive motor 9 are disposed in different locations in a direction in which a sheet is conveyed. The conveyor rollers 1*a*, 1*b* are arranged so as to be able to move in a direction intersecting the direction of conveyance by means of sheet shift means which are driven by shift motors 11*a*, 11*b*. Sheet sensors 13*a*, 13*b* are provided in the reference position for the side edge of the sheet. If the sheet sensor 13*a* (or 13*b*) does not detect the side edge of the sheet 2, the shift motors 11*a*, 11*b* are controlled in such a way that a conveyor roller 1*a* (or 1*b*) corresponding to the sheet sensor approaches the sheet side edge reference position. In contrast, if the sheet sensor detects the side edge of the sheet 2, the shift motors are controlled in such a way that the conveyor roller departs from the reference position.

19 Claims, 16 Drawing Sheets

SHEET ALIGNMENT DEVICE, AND IMAGE FORMING APPARATUS EQUIPPED WITH THE SAME

BACKGROUND OF THE INVENTION

The present invention relates to a sheet alignment device which corrects the skew (or oblique movement) of paper during conveyance or a positional displacement of paper in a direction intersecting the direction of conveyance. Further, the present invention relates to an image forming apparatus, such as a copier, equipped with the sheet alignment device.

In an image forming apparatus, in a case where paper is skewed during conveyance or is displaced in a direction intersecting a direction in which a sheet is conveyed (hereinafter simply referred to as a direction of conveyance), an image is formed in a position offset from the paper. Particularly, in a copier having double-sided copying capability, after an image has been formed on a first surface, another image is formed on a second surface by inversion of paper through use of an inverting device. If paper is skewed during conveyance or is displaced in a direction intersecting the direction of conveyance, the images on the first and second surfaces deviate from each other.

For this reason, in order to correct skewing of paper during conveyance or side misregistration, such as positional displacements of paper in a direction intersecting the direction of conveyance, a sheet alignment device is employed. Various types of sheet alignment devices have already been proposed, and representative examples of such devices will be mentioned hereinbelow.

In a known existing sheet alignment device, a pair of stoppers are situated in different positions on both sides of a sheet transport path in a direction intersecting the direction of conveyance in such a way as to advance or retract. A lead skew of the paper is corrected by bringing the leading edge of the paper into contact with the pair of stoppers while the paper is being conveyed. Subsequently, the pair of stoppers are retracted from the sheet transport path (see; for example, the Unexamined Japanese Patent Application Publication No. Sho 63-225052).

In another known existing sheet alignment device, a pair of paper sensors are situated in different positions on both sides of the sheet transport path in the direction intersecting the direction of conveyance. The amount of skew is calculated from a difference between the instant when one end of the leading edge of paper passes by the sensors and the instant when the other end of the leading edge of the paper passes by the sensors. The lead skew is corrected by independent control of the rotational speed of two conveyor rollers, which are spaced apart from each other in the direction intersecting the direction of conveyance, according to the thus-obtained amount of skew (see; e.g., the Unexamined Japanese Patent Application Publication No. Hei 3-53219).

In still another known existing sheet alignment device, a reference wall is disposed on one side of the sheet transport path, and skew rollers are disposed on the sheet transport path. The skew rollers draw paper toward the reference wall during conveyance, to thereby bring the side edge of the paper into contact with the reference wall. As a result, a side skew of the paper is corrected, and side registration of the paper is accomplished simultaneously (see; e.g., the Unexamined Japanese Patent Application Publication No. Sho 57-90344).

In yet another known existing sheet alignment device, conveyor rollers used for the purpose of carrying paper are disposed so as to be movable in the axial direction of the conveyor roller. A paper sensor used for the purpose of detecting the side edge of paper is disposed in the reference position for side registration in the vicinity of the conveyor rollers. This paper sensor detects whether or not the side of the paper being conveyed is in the reference position. The side registration of the paper is accomplished by moving the conveyor rollers in the axial direction on the basis of the result of detection (see; e.g., the Unexamined Japanese Patent Application Publication No. Sho 59-4552).

The existing sheet alignment device described in the Unexamined Japanese Patent Application Publication No. Sho 63-225052 is configured so as to bring the leading edge of paper into contact with one of the stoppers. Accordingly, the lead skew of the paper can be corrected. However, the side registration of the paper cannot be accomplished. Further, a sound is produced when the paper abuts the stopper, and the paper is temporarily stopped, thereby resulting in deterioration of productivity.

Further, there is only a narrow range of correctable skews, and there is a difference in the degree of parallelism between the leading edge and trailing edge of the paper. For this reason, in the case of a copier having double-sided copying capability, the leading edge and trailing edge of the paper are interchanged with each other when the paper is inverted by the inversion device. If the skew of the paper is corrected by bringing the leading edge of the paper into contact with the stopper, images formed on the first and second surfaces deviate from each other.

The existing sheet alignment device described in the Examined Japanese Patent Application Publication No. Hei 3-53219 is structured so as to correct skew with reference to the leading edge of paper, as is the previous existing sheet alignment device. Therefore, it is impossible for the device to accomplish side registration of the paper, so that images formed on the first and second surfaces deviation from each other during double-sided copying operation. Further, there is a need to calculate the amount of skew from a difference between the instant when one end of the leading edge of paper passes by the pair of paper sensors and the instant when the other end of the leading edge of the paper passes by the pair of paper sensors. A velocity profile of the conveyor rollers must be calculated from the amount of skew. Expensive calculation means is required for the purpose of calculating the velocity profile. If the conveyor rollers are abraded, the accuracy of correction of skew is correspondingly deteriorated.

The existing sheet alignment apparatus described in the Unexamined Japanese Patent Application Publication No. Sho 57-90344 is configured so as to accomplish the side registration of paper by bringing the paper into contact with the reference wall by means of the carrying force of the skew rollers. If the carrying force of the skew rollers is too great, thin paper may become buckled. In contrast, if the carrying force is too weak, it becomes impossible to carry thick paper to the reference wall. For these reasons, the range of applicable paper quality is narrow. In addition, the skew rollers are apt to abrasion, and the accuracy of side registration of paper may change according to paper quality.

The existing sheet alignment apparatus described in the Unexamined Japanese Patent Application Publication No. Sho 59-4552 is configured so as to align the side edge of paper with the reference position only by transverse movement of paper in parallel with the direction of conveyance (or in the direction orthogonal to the direction of conveyance) while the paper is being conveyed.

Accordingly, it is impossible for the device to correct skewing of paper. The device is able to yield an advantage only when paper is conveyed without being skewed.

SUMMARY OF THE INVENTION

The present invention has been contrived in view of the drawbacks in the art, and the object of the present invention is to provide a sheet alignment device which is capable of simultaneously correcting skew and side misregistration regardless of paper quality of a sheet and prevents an image formed on a first surface of the sheet from deviating from another image formed on a second surface of the sheet even during double-sided copying operation.

A sheet alignment device according to the present invention comprises sheet conveyor means for conveying a sheet; sheet rotation means for rotating the sheet; sheet side edge detection means for detecting the side edge of the sheet while the sheet is being conveyed by the sheet conveyor means; and control means for controlling a direction in which the sheet rotation means rotates, on the basis of the result of detection by the sheet edge detection means.

In the sheet alignment device having the foregoing structure, the sheet side edge detection means detects the side edge of the sheet while the sheet is being conveyed by the sheet conveyor means. On the basis of the result of detection by the sheet side edge detection means, the control means controls the direction in which the sheet rotation means rotates the sheet. As described above, the sheet rotation means rotates the sheet in the direction based on the result of detection by the sheet side edge detection means while the sheet is being conveyed by the sheet conveyor means, thereby simultaneously correcting the skew and side misregistration of a sheet.

According to another aspect of the present invention, there is provided a sheet alignment device comprising sheet conveyor means for conveying a sheet; sheet rotation means for rotating the sheet; sheet shift means for shifting the sheet in a direction intersecting the direction of conveyance; side edge detection means for detecting the side edge of the sheet while the sheet is being conveyed by the sheet conveyor means; and control means for controlling the direction in which the sheet rotation means rotates the sheet and the direction in which the sheet shift means shifts the sheet, on the basis of the result of detection by the sheet side edge detection means.

In the sheet alignment device having the foregoing structure, the sheet side edge detection means detects the side edge of the sheet while the sheet is being conveyed by the sheet conveyor means. On the basis of the result of detection by the sheet side edge detection means, the control means controls the direction in which the sheet rotation means rotates the sheet and the direction in which the sheet shift means shifts the sheet. The sheet is rotated by the sheet rotation means and is shifted by the sheet shift means in the direction based on the result of detection by the sheet side edge detection means while the sheet is being conveyed by the sheet conveyor means, thereby simultaneously correcting the skew and side misregistration of a sheet.

Particularly, the control means controls the sheet shift means so as to shift the sheet in parallel with the direction of conveyance to a position where the sheet side edge detection means detects the side edge of the sheet. Accordingly, If the sheet being conveyed is greatly displaced from the sheet side edge detection means, it becomes possible for the sheet alignment device to immediately start correcting the skew and side misregistration of the sheet by moving the sheet in parallel with the direction of conveyance through use of the paper shift means.

DETAILED DESCRIPTION OF THE PREFERRED EMBODIMENTS

With reference to the accompanying drawings, preferred embodiments of the present invention will be described in detail.

Figure 1:
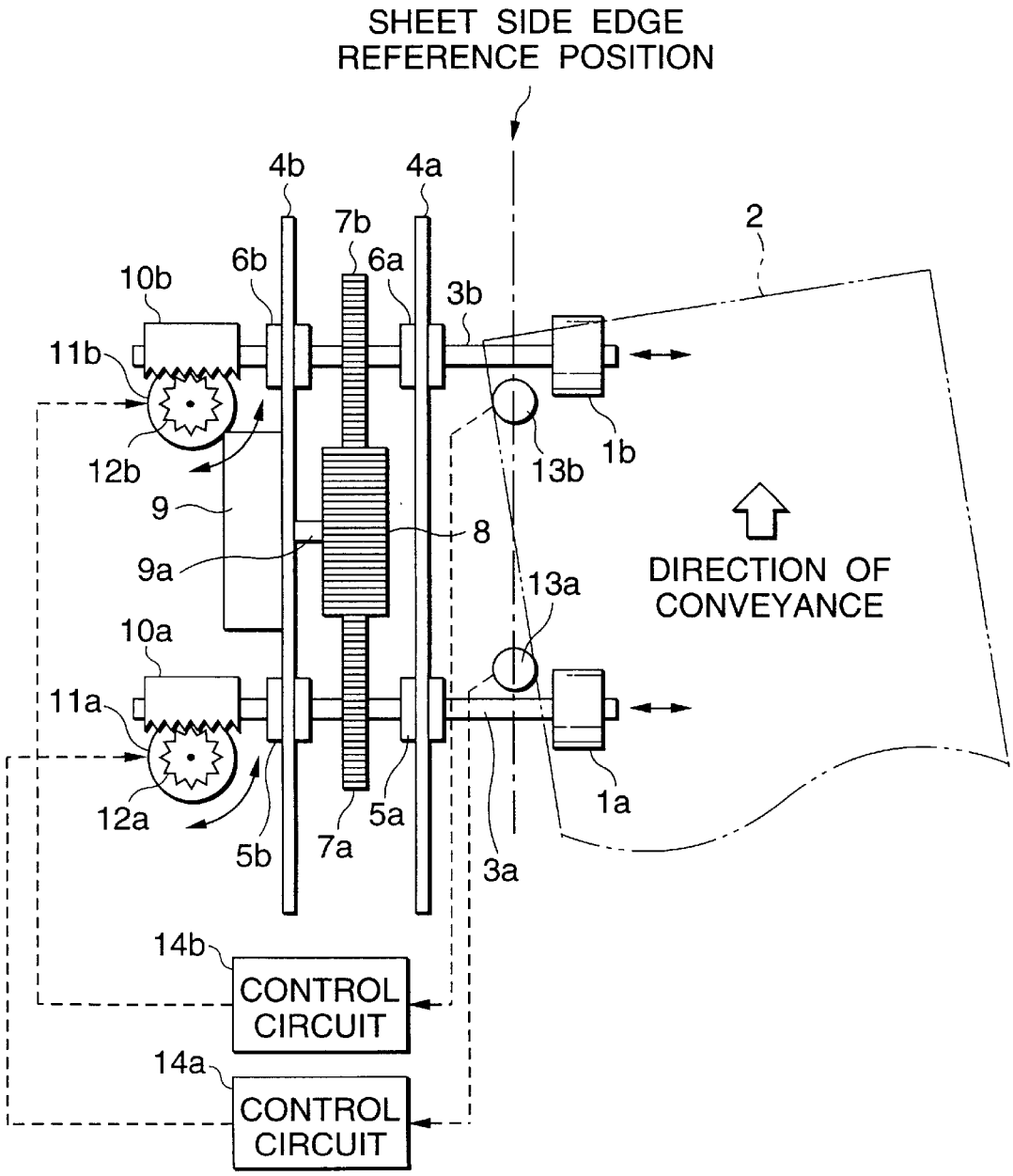
FIG. 1 is a schematic representation showing the configuration of a sheet alignment device according to a first embodiment of the present invention.

FIG. 1 is a schematic representation showing a sheet alignment device in accordance with a first embodiment of the present invention. In FIG. 1, conveyor rollers 1*a*, 1*b* are disposed in different positions in a direction in which a sheet 2 is conveyed (i.e., a direction designated by arrow in FIG. 1 which will be hereinafter simply referred to as a direction of conveyance). The conveyor roller 1*a* is fixed to one end of a rotary shaft 3*a*, and the conveyor roller 1*b* is fixed to one end of a rotary shaft 3*b*. The intermediate portion of the rotary shaft 3*a* is supported by shaft bearings 5*a*, 5*b* in such a way as to be rotatable with respect to frames 4*a*, 4*b* and movable in a direction intersecting the direction of conveyance. The intermediate portion of the rotary shaft 3*b* is supported by shaft bearings 6*a*, 6*b* in such a way as to be rotatable with respect to the frames 4*a*, 4*b* and movable in the direction intersecting the direction of conveyance.

A drive gear 7*a* is fitted around the intermediate area of the rotary shaft 3*a* between the frames 4*a* and 4*b*, and a drive gear 7*b* is fitted around the intermediate area of the rotary shaft 3*b* between the frames 4*a* and 4*b*. An intermediate gear 8 is interposed between the drive gears 7*a*, 7*b* while they are in mesh. The intermediate gear 8 is attached to a rotary shaft 9*a* of a rotary drive motor 9 attached to the frame 4*b*. A servo motor or stepping motor is used as the rotary drive motor 9 which rotatively drives the conveyor rollers 1*a*, 1*b*.

In short, the intermediate gear 8 is rotatively driven by the rotary drive motor 9, and the rotational fore of the gear 8 is transmitted to the drive gears 7*a*, 7*b* as rotational force in the same direction of rotation. Further, the rotational force is transmitted to the conveyor rollers 1*a*, 1*b* via the rotary shafts 3*a*, 3*b* as force used for carrying the sheet 2. First and second sheet conveyor means which individually impart conveying force to the sheet 2 are constituted of the conveyor rollers 1*a*, 1*b*, the rotary shafts 3*a*, 3*b*, the drive gears 7*a*, 7*b*, the intermediate gear 8, the rotary drive motor 9, and their peripheral members.

An axially-threaded gear 10*a* is attached to the other end of the rotary shaft 3*a*, and an axially-threaded gear 10*b* is attached to the other end of the rotary shaft 3*b*. The gears 10*a*, 10*b* mesh with gears 12*a*, 12*b* attached to the respective rotary shafts of shift motors 11*a*, 11*b*. A DC motor is used as the shift motors 11*a*, 11*b*. The shift motors 11*a*, 11*b* serve as drive sources used for moving the conveyor rollers 1*a*, 1*b* in a direction intersecting the direction of conveyance.

More specifically, the gears 12*a*, 12*b* are rotatively driven by means of the shift motors 11*a*, 11*b*, and the rotational movement of the gears 12*a*, 12*b* is transmitted to the rotary shafts 3*a*, 3*b* via the gears 10*a*, 10*b* in the form of linear motion corresponding to the direction of rotation of the shift motors 11*a*, 11*b*. As a result, the conveyor rollers 1*a*, 1*b* fixed to the respective ends of the rotary shafts 3*a*, 3*b* are actuated in the direction intersecting the direction of conveyance.

Sheet rotation means for rotating the sheet 2 and sheet shift means for shifting the sheet 2 are formed from the conveyor rollers 1*a*, 1*b*, the rotary shafts 3*a*, 3*b*, the gears 10*a*, 10*b*, the shift motors 11*a*, 11*b*, the gears 12*a*, 12*b*, and their peripheral members. In short, when only one of the conveyor rollers 1*a*, 1*b* is shifted in one direction, these elements function as the sheet rotation means for rotating the sheet 2. In contrast, when both the conveyor rollers 1*a* and 1*b* are shifted, the elements function as sheet shift means for shifting the sheet 2.

The conveyor rollers 1*a*, 1*b* pair up with driven rollers (not shown), and the sheet 2 is conveyed while being sandwiched between the conveyor rollers 1*a*, 1*b* and the driven rollers. The driven rollers are configured so as to be axially movable in association with the conveyor rollers 1*a*, 1*b* in order to facilitate the rotational movement or shift of the sheet 2. However, there is no necessity for configuring the driven rollers so as to be axially movable. If the driven rollers are designed so as to be axially stationary, it is only essential that the driven rollers be formed from material, such as plastics, which is apt to cause slipping of the sheet 2.

Two sheet sensors 13*a*, 13*b* are disposed in different positions in the direction of conveyance on the left side of the conveyor rollers 1*a*, 1*b*; e.g., in the positions in the vicinity of the conveyor rollers 1*a*, 1*b*, as sheet side edge detection means for detecting the side edge of the sheet 2. The positions where the sheet sensors 13*a*, 13*b* are used as the reference position for the side edge of the sheet. An optical sensor comprising a combination of a light-emitting element and a light-receiving element is used as the sheet sensors 13*a*, 13*b*.

Detection output signals from the respective sheet sensors 13*a*, 13*b* are supplied to control circuits 14*a*, 14*b*. On the basis of the result of detection by the sheet sensors 13*a*, 13*b*, the control circuits 14*a*, 14*b* control the direction in which the shift motors 11*a*, 11*b* are rotated; i.e., the direction in which the conveyor rollers 11*a*, 11*b* are shifted. The specific control logic of the control circuits 14*a*, 14*b* is provided in Table 1.

TABLE 1

| | DETECTION RESULT 13a/13b | CONTROL 11a/11b |
|---|---|---|
| case 1 | PAPER EMPTY | ROTATE THE MOTOR c.c.w. |
| case 2 | PAPER DETECTED | ROTATE THE MOTOR c.w. |

More specifically, when the sheet sensor 13*a* does not detect the side edge of the sheet 2; i.e., paper empty (case 1), the control circuit 14*a* rotatively drives the shift motor 11*a* in a counterclockwise direction in FIG. 1 when receiving the detection output from the sheet sensor 13*a*. As a result, the rotary shaft 3*a* is shifted in a leftward direction in FIG. 1, whereby the sheet 2 is moved by way of the conveyor roller 1*a* to the position where the sheet sensor 13*a* detects the side edge of the sheet 2.

When the sheet sensor 13*a* detects the side edge of the sheet 2; i.e., in the case of paper being detected (case 2), the control circuit 14*a* rotatively drives the shift motor 11*a* in a clockwise direction in FIG. 1 when receiving the detection output signal from the sheet sensor 13*a*. As a result, the rotary shaft 3*a* is shifted in a rightward direction shown in FIG. 1, whereby the sheet 2 is shifted by way of the conveyor roller 1*a* to the position where the sheet sensor 13*a* does not detect the side edge of the sheet 2.

When the sheet sensor 13*b* does not detect the side edge of the sheet 2; i.e., paper empty (case 1), the control circuit 14*b* rotatively drives the shift motor 11*b* in a counterclockwise direction in FIG. 1 when receiving the detection output from the sheet sensor 13*b*. As a result, the rotary shaft 3*b* is shifted in a leftward direction in FIG. 1, whereby the sheet 2 is moved by way of the conveyor roller 1*b* to the position where the sheet sensor 13*b* detects the side edge of the sheet 2.

When the sheet sensor 13*b* detects the side edge of the sheet 2; i.e., in the case of paper being detected (case 2), the control circuit 14*b* rotatively drives the shift motor 11*b* in a clockwise direction in FIG. 1 when receiving the detection output signal from the sheet sensor 13*b*. As a result, the rotary shaft 3*b* is shifted in a rightward direction shown in FIG. 1, whereby the sheet 2 is shifted by way of the conveyor roller 1*b* to the position where the sheet sensor 13*b* does not detect the side edge of the sheet 2.

Figure 2:
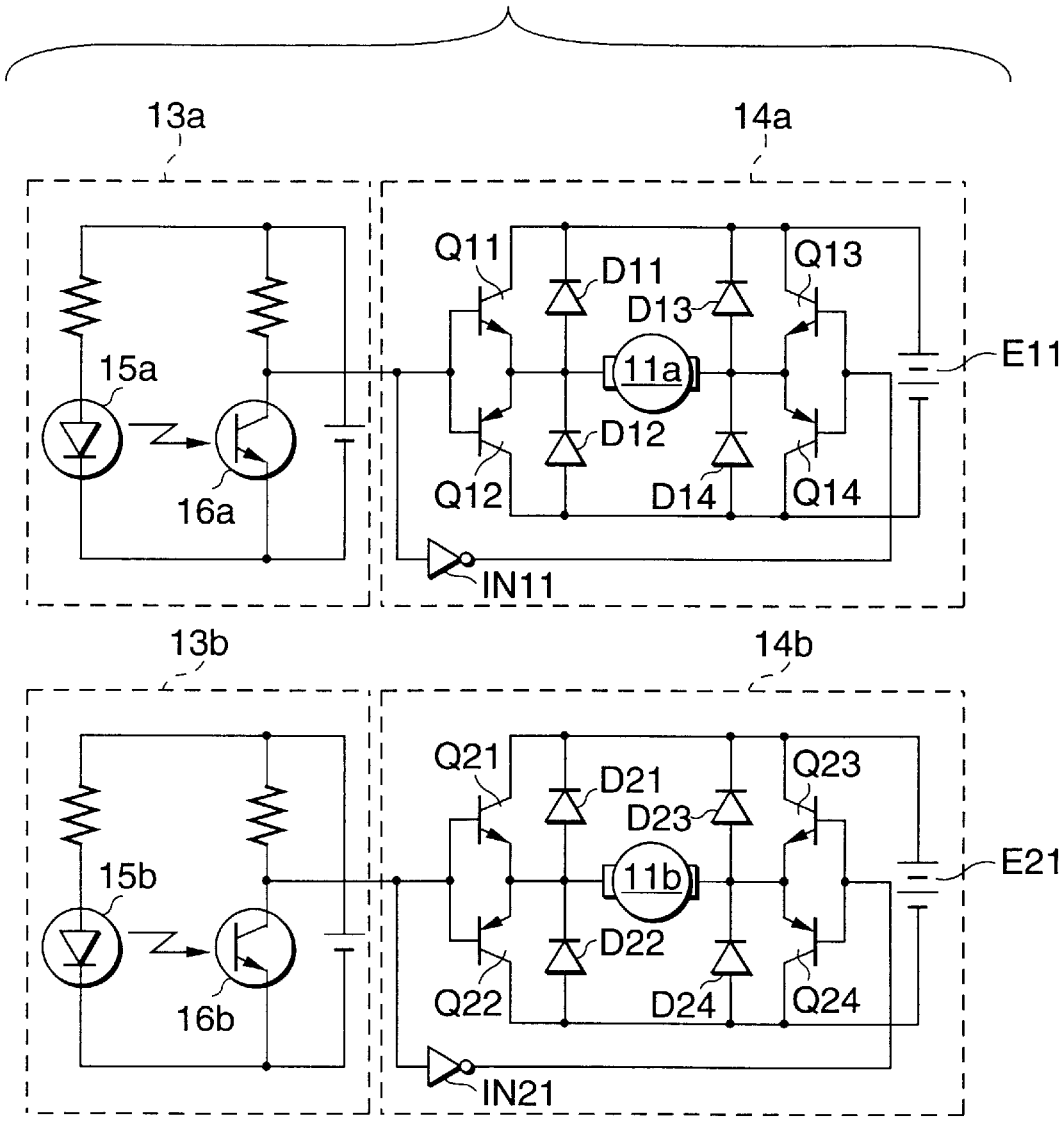
FIG. 2 is a circuit diagram showing one example of the configuration of a control circuit according to the first embodiment.

FIG. 2 is a circuit diagram showing one example of the configuration of each of the control circuits 14*a*, 14*b*. In FIG. 2, the control circuit 14*a* comprises an n-p-n transistor Q11 and a p-n-p transistor Q12 which are connected in series with each other across the positive and negative sides of a d.c. power source E11; an n-p-n transistor Q13 and a p-n-p transistor Q14 which are connected in series with each other across the positive and negative sides of the d.c. power source E11; diodes D11 to D14 which are connected in parallel with the respective transistors Q11 to Q14 in the opposite direction; and an inverter IN11 for supplying an input which is in reversal phase with the base of each of the transistors Q11, Q12-to the base of each of the transistors Q13, Q14.

In the control circuit 14*a*, one end of the shift motor 11*a* is connected to a node common to the emitters of the transistors Q11, Q12, and the other end of the shift motor 11*a* is connected to a node common to the emitters of the transistors Q13, Q14. When the control circuit 14*a* receives the detection output signal from the sheet sensor 13*a*, the signal is directly delivered to the base of each of the transistors Q11, Q12. The signal is delivered to the base of each of the transistors Q13, Q14 after having been inverted by the inverter IN11.

Assuming that the control circuit 14*a* receives a high-level detection output signal from the sheet sensor 13*a*, the transistors Q11, Q14 are turned on, and the transistors Q12, Q13 are turned off. As a result, a d.c. current flowing from the left side to the right side in FIG. 1 is supplied to the shift motor 11*a*. In contrast, if the control circuit 14*a* receives a low-level detection output signal from the sheet sensor 13*a*, the transistors Q12, Q13 are turned on, and the transistors Q11, Q14 are turned off. As a result, a d.c. current flowing from the right side to the left side in FIG. 1 is supplied to the shift motor 11*a*.

In this way, since the direction-in which the shift motor 11*a* is rotated-changes according to the result of detection by the sheet sensor 11*a*, the direction in which the conveyor roller 11*a* is shifted can be controlled. The shift motor 11*a* is a load of inductance, and great counter electromotive force arises if a drive voltage is abruptly interrupted. The diodes D11 to D14 are provided in order to prevent the transistors Q11 to Q14 from being broken by the counter electromotive force. More specifically, the diodes D11 to D14 act as flywheel diodes which absorb counter electromotive force.

The control circuit 14*b* is completely the same in configuration as that of the control circuit 14*a*. The control circuit 14*b* comprises an n-p-n transistor Q21 and a p-n-p transistor Q22 which are connected in series with each other across the positive and negative sides of a d.c. power source E21; an n-p-n transistor Q23 and a p-n-p transistor Q24 which are connected in series with each other across the positive and negative sides of the d.c. power source E21; diodes D21 to D24 which are connected in parallel with the respective transistors Q21 to Q24 in the opposite direction; and an inverter IN21 for supplying an input which is in reversal phase with the base of each of the transistors Q21, Q22-to the base of each of the transistors Q23, Q24.

In the control circuit 14*b*, one end of the shift motor 11*b* is connected to a node common to the emitters of the transistors Q21, Q22, and the other end of the shift motor 11*a* is connected to a node common to the emitters of the transistors Q23, Q24. When the control circuit 14*b* receives the detection output signal from the sheet sensor 13*b*, the signal is directly delivered to the base of each of the transistors Q21, Q22. The signal is delivered to the base of each of the transistors Q23, Q24 after having been inverted by the inverter IN21. The transistors Q21 to Q24 and the diodes D21 to D24 operate in the same way as do the transistors and diodes of the control circuit 14*a*, and therefore their explanations will be omitted.

By way of example, the sheet sensor 13*a* comprises a combination of a light-emitting element 15*a*, such as a light-emitting diode, and a light-receiving element 16*a*, such as a phototransistor. Similarly, the sheet sensor 13*b* comprises a combination of a light-emitting element 15*b* and a light-receiving element 16*b*. In a case where the sheet sensors 13*a*, 13*b* are of transmission type, the light emitted from the light-emitting elements 15*a*, 15*b* is interrupted by the sheet 2 when the side edge of the sheet 2 is detected, thereby turning off the light-receiving elements 16*a*, 16*b*. As a result, a high-level signal is output as a detection result. In contrast, when the side edge of the sheet 2 is not detected, the light emitted from the light-emitting elements 15*a*, 15*b* directly enters the light-receiving elements 16*a*, 16*b*, thereby turning on the light-receiving elements 16*a*, 16. Accordingly, a low-level signal is output as a detection result.

In a case where the sheet sensors 13*a*, 13*b* are of reflection type, the light emitted from the light-emitting elements 15*a*, 15*b* is reflected from the sheet 2 when the side edge of the sheet 2 is detected, and the thus-reflected light enters the light-receiving elements 16*a*, 16*b*. As a result, the light-receiving elements 16*a*, 16*b* are turned on, so that a high-level signal is output as a detection result. In contrast, when the side edge of the sheet 2 is not detected, no light is reflected from the sheet 2. As a result, the light-receiving elements 16*a*, 16*b* are turned off, so that a low-level signal is output as a detection result. However, the sheet sensors 13*a*, 13*b* are not limited to these types. Any type of sensor can be used as the sheet sensors, so long as it can detect the side edge of the sheet 2.

As mentioned previously, in the sheet alignment device according to the first embodiment, the conveyor rollers 11*a*, 11*b* which are driven by the rotary drive motor 9 are disposed in different positions in the direction of conveyance. The conveyor rollers 1*a*, 1*b* are arranged so as to be movable in the direction intersecting the direction of conveyance by means of the sheet shift means that employ the shift motors 11*a*, 11*b* as drive sources. The sheet sensors 13*a*, 13*b* are provided in the sheet side edge reference positions. When the sheet sensor 13*a* (or 13*b*) does not detect the side edge of the sheet 2, the shift motors 11*a*, 11*b* are controlled so as to cause the conveyor roller 1*a* (or 1*b*) corresponding to the sheet sensor to approach the sheet side edge reference position. In contrast, when the sheet sensor detects the side edge of the sheet 2, the shift motors 11*a*, 11*b* are controlled so as to cause the conveyor roller to depart from the sheet side edge reference position. Through these operations, skew and side misregistration of the sheet 2 can be simultaneously corrected while the sheet is being conveyed.

Particularly, both the conveyor rollers 1*a* and 1*b* are arranged so as to be movable in the direction intersecting the direction of conveyance, and the sheet 2 can be rotated in both clockwise and counterclockwise directions shown in FIG. 1 while being conveyed. Skew and side misregistration of the sheet 2 can be quickly corrected. Further, the sheet 2 can be shifted in parallel with the direction of conveyance during the course of conveyance by simultaneously shifting the conveyor rollers 1*a*, 1*b* in the same direction. If the sheet 2 is conveyed while being extremely spaced apart from the sheet side edge reference position, the sheet 2 can be moved to the sheet side edge reference position in parallel with the direction of conveyance by virtue of the foregoing feature. Accordingly, skew and side misregistration of the sheet 2 can be quickly corrected.

It is only essential that the control circuits 14*a*, 14*b* control, on the basis of the result of detection by the sheet sensors 13*a*, 13*b*, the direction in which the shift motors 11*a*, 11*b* are actuated, and it is not necessary for the control circuits 14*a*, 14*b* to perform any arithmetic operation. Therefore, the control circuits 14*a*, 14*b* can be formed into simple electronic circuits. After the sheet 2 has passed through the conveyor rollers 1*a*, 1*b*, the conveyor rollers 1*a*, 1*b* are returned to their original positions (e.g., the intermediate position within the extent to which the conveyor rollers 1*a*, 1*b* can move).

Figure 3:
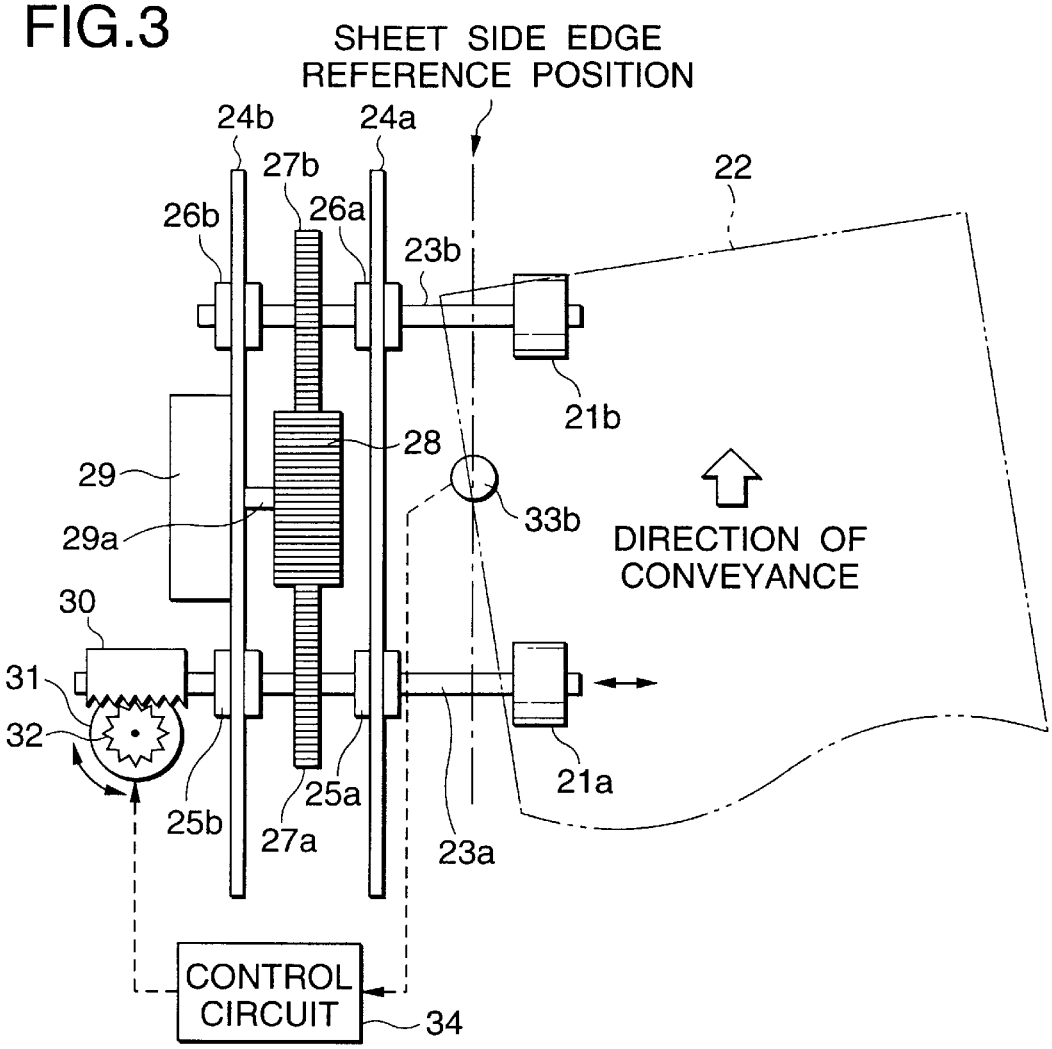
FIG. 3 is a schematic representation showing the configuration of a sheet alignment device according to a second embodiment of the present invention.

FIG. 3 is a schematic representation showing a sheet alignment device in accordance with a second embodiment of the present invention. In FIG. 3, conveyor rollers 21*a*, 21*b* are disposed in different positions in a direction in which a sheet 22 is conveyed (i.e., a direction designated by arrow in FIG. 3 which will be hereinafter simply referred to as a direction of conveyance). The conveyor roller 21*a* is fixed to one end of a rotary shaft 23*a*, and the conveyor roller 21*b* is fixed to one end of a rotary shaft 23*b*. Of the rotary shafts 23*a*, 23*b*, the rotary shaft 23*a* which is placed in a rearward position in relation to the rotary shaft 23*b* in the direction of conveyance is supported by shaft bearings 25*a*, 25*b* in such a way as to be rotatable with respect to frames 24*a*, 24*b* and movable in an axial direction or a direction intersecting the direction of conveyance. The rotary shaft 23*b* which is placed in a forward position in relation to the rotary shaft 23*a* in the direction of conveyance is supported by shaft bearings 26*a*, 26*b* in such a way as to be rotatable with respect to the frames 24*a*, 24*b*.

A drive gear 27*a* is fitted around the intermediate area of the rotary shaft 23*a* between the frames 24*a* and 24*b*, and a drive gear 27*b* is fitted around the intermediate area of the rotary shaft 23*b* between the frames 24*a* and 24*b*. An intermediate gear 28 is interposed between the drive gears 27*a*, 27*b* while they are in mesh. The intermediate gear 28 is attached to a rotary shaft 29*a* of a rotary drive motor 29 attached to the frame 24*b*. A servo motor or stepping motor is used as the rotary drive motor 29 which rotatively drives the conveyor rollers 21*a*, 21*b*.

In short, the intermediate gear 28 is rotatively driven by the rotary drive motor 29, and the rotational fore of the gear 28 is transmitted to the drive gears 27*a*, 27*b* as rotational force in the same direction of rotation. Further, the rotational force is transmitted to the conveyor rollers 21*a*, 21*b* via the rotary shafts 23*a*, 23*b* as force used for carrying the sheet 22. First and second sheet conveyor means which individually impart conveying force to the sheet 22 are constituted of the conveyor rollers 21*a*, 21*b*, the rotary shafts 23*a*, 23*b*, the drive gears 27*a*, 27*b*, the intermediate gear 28, the rotary drive motor 29, and their peripheral members.

An axially-threaded gear 30 is attached to the other end of the rotary shaft 23*a*. A gear 32 attached to the rotary shaft of the shift motor 31 meshes with the gear 30. A DC motor is used as the shift motor 31. The shift motor 31 serves as a drive source used for moving the conveyor roller 21*a* in a direction intersecting the direction of conveyance. More specifically, the gear 32 is rotatively driven by means of the shift motor 31, and the rotational movement of the gear 32 is transmitted to the rotary shaft 23*a* via the gear 30 in the form of linear motion corresponding to the direction of rotation of the shift motor 31. As a result, the conveyor roller 21*a* fixed to one end of the rotary shaft 23*a* is actuated in the direction intersecting the direction of conveyance.

Sheet rotation means for rotating the sheet 22 and sheet shift means for shifting the sheet 22 are formed from the conveyor rollers 21*a*, 21*b*, the rotary shafts 23*a*, 23*b*, the gears 30*a*, 30*b*, the shift motors 31*a*, 31*b*, the gear 32, and their peripheral members. In short, when the conveyor roller 21*a* is shifted in a rightward direction shown in FIG. 3, the sheet 22 is rotated around the vicinity of the conveyor roller 21*b* in a counterclockwise direction shown in FIG. 3. In contrast, when the conveyor roller 21*a* is shifted in a leftward direction shown in FIG. 3, the sheet 22 is rotated in a clockwise direction shown in FIG. 3.

The conveyor rollers 21*a*, 21*b* pair up with driven rollers (not shown), and the sheet 22 is conveyed while being sandwiched between the conveyor rollers 21*a*, 21*b* and the driven rollers. The driven roller paired up with the conveyor roller 21*a* is configured so as to be axially movable in association with the conveyor roller 21*a* in order to facilitate the rotational movement of the sheet 22. However, there is no necessity for configuring the driven rollers so as to be axially movable. If the driven roller is designed so as to be axially stationary, it is only essential that the driven rollers be formed from material, such as plastics, which is apt to cause slipping of the sheet 22. If the driven roller paired up with the conveyor roller 21*b* is made up of a plastic roller, the rotation of the sheet 22 becomes easy.

A single sheet sensor 33 is disposed, as sheet side edge detection means for detecting the side edge of the sheet 22, in substantially the middle position between the conveyor rollers 21*a*, 21*b* on the left side of the conveyor rollers 21*a*, 21*b* shown in FIG. 3. The position where the sheet sensor 33 is disposed is used as the reference position for the side edge of a sheet. An optical sensor comprising a light-emitting element and a light-receiving element in combination is used as the sheet sensor 33. A detection output signal from the sheet sensor 33 is supplied to a control circuit 34. On the basis of the result of detection by the sheet sensor 33, the control circuit 34 controls the direction in which the shift motor 31 is rotated; i.e., the direction in which the conveyor roller 21*a* is shifted. The specific control logic of the control circuit 34 is provided in Table 2.

TABLE 2

| | DETECTION RESULT 33 | CONTROL 31 |
|---|---|---|
| case 1 | PAPER EMPTY | ROTATE THE MOTOR c.c.w. |
| case 2 | PAPER DETECTED | ROTATE THE MOTOR c.w. |

More specifically, when the sheet sensor 33 does not detect the side edge of the sheet 22; i.e., paper empty (case 1), the control circuit 34 rotates the shift motor 31 in a counterclockwise direction in FIG. 3 when receiving the detection output from the sheet sensor 33. As a result, the rotary shaft 23*a* is shifted in a leftward direction in FIG. 3, whereby the sheet 22 is moved by way of the conveyor roller 21*a* to the position where the sheet sensor 33 detects the side edge of the sheet 22. When the sheet sensor 33 detects the side edge of the sheet 22; i.e., in the case of paper being detected (case 2), the control circuit 34 rotatively drives the shift motor 31 in a clockwise direction in FIG. 3 when receiving the detection output signal from the sheet sensor 33. As a result, the rotary shaft 23*a* is shifted in a rightward direction shown in FIG. 3, whereby the sheet 22 is shifted by way of the conveyor roller 21*a* to the position where the sheet sensor 33 does not detect the side edge of the sheet 22.

Figure 4:
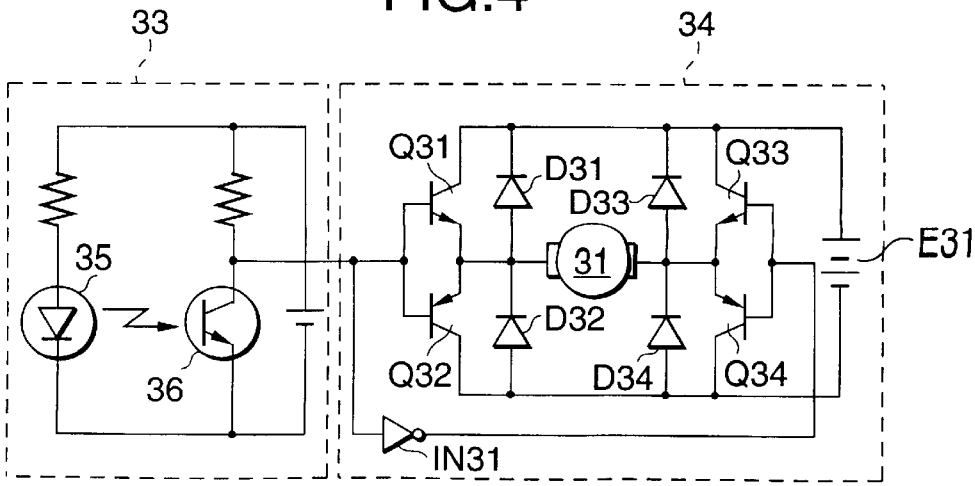
FIG. 4 is a circuit diagram showing one example of the configuration of a control circuit according to the second embodiment.

FIG. 4 is a circuit diagram showing one example of the configuration of the control circuit 34. In FIG. 4, the control circuit 34 comprises an n-p-n transistor Q31 and a p-n-p transistor Q32 which are connected in series with each other across the positive and negative sides of a d.c. power source 31; an n-p-n transistor Q33 and a p-n-p transistor Q34 which are connected in series with each other across the positive and negative sides of the d.c. power source 31; diodes D31 to D34 which are connected in parallel with the respective transistors Q31 to Q34 in the opposite direction; and an inverter IN31 for supplying an input which is in reversal phase with the base of each of the transistors Q31, Q32-to the base of each of the transistors Q33, Q34.

In the control circuit 34, one end of the shift motor 31 is connected to a node common to the emitters of the transistors Q31, Q32, and the other end of the shift motor 31 is connected to a node common to the emitters of the transistors Q33, Q34. When the control circuit 34 receives the detection output signal from the sheet sensor 33, the signal is directly delivered to the base of each of the transistors Q31, Q32. The signal is delivered to the base of each of the transistors Q33, Q34 after having been inverted by the inverter IN31.

Assuming that the control circuit 34 receives a high-level detection output signal from the sheet sensor 33, the transistors Q31, Q34 are turned on, and the transistors Q32, Q33 are turned off. As a result, a d.c. current flowing from the left side to the right side in FIG. 3 is supplied to the shift motor 31. In contrast, if the control circuit 34 receives a low-level detection output signal from the sheet sensor 33, the transistors Q32, Q33 are turned on, and the transistors Q31, Q34 are turned off. As a result, a d.c. current flowing from the right side to the left side in FIG. 3 is supplied to the shift motor 31.

In this way, since the direction-in which the shift motor 31 is rotated-changes according to the result of detection by the sheet sensor 31, the direction in which the conveyor roller 21*a* is shifted can be controlled. Although the sheet sensor 33 is used which comprises a light-emitting element 35 such as a light-emitting diode and a light-receiving element 36 such as a phototransistor in combination, it is evident that the sheet sensor is not limited to this type of sensor, as in the first embodiment.

As mentioned previously, in the sheet alignment device according to the second embodiment, the conveyor rollers 21*a*, 21*b* which are driven by the rotary drive motor 29 are disposed in different positions in the direction of conveyance. The sheet shift means that is driven by the shift motor 31 is arranged so as to be able to shift in a direction intersecting the direction of conveyance the conveyor roller 21*a* placed in a rearward position in the direction of conveyance. When the sheet sensor 33 does not detect the side edge of the sheet 22, the conveyor roller 21*a* is controlled so as to approach the sheet side edge reference position. In contrast, when the sheet sensor 33 detects the side edge of the sheet 22, the conveyor roller 21*a* is controlled so as to depart from the sheet side edge reference position. Through these operations, the skew and side misregistration of the sheet 22 can be simultaneously corrected while the sheet is being conveyed.

As mentioned previously, in the case of the second embodiment in which only the conveyor roller 21*a* placed in a rearward position in the direction of sheet conveyance can be moved, it takes a longer time to correct both the skew and side misregistration of the sheet in comparison with the time required for the first embodiment in which both the conveyor rollers 1*a*, 1*b* can be moved. However, the sheet shift means and the sheet detection means can be grouped into one system, thereby yielding the advantage of enabling inexpensive configuration of the sheet alignment device. Further, since the control circuit 34 can also be grouped into one system, the control circuit requires only simple control; i.e., switching of the direction in which the shift motor 31 is rotated on the basis of the result of detection by the sheet sensor 31, and does not any require arithmetic operation. Accordingly, the sheet alignment device also yields the advantage of enabling configuration of the control circuit 34 in the form of a simple electronic circuit.

Figure 5:
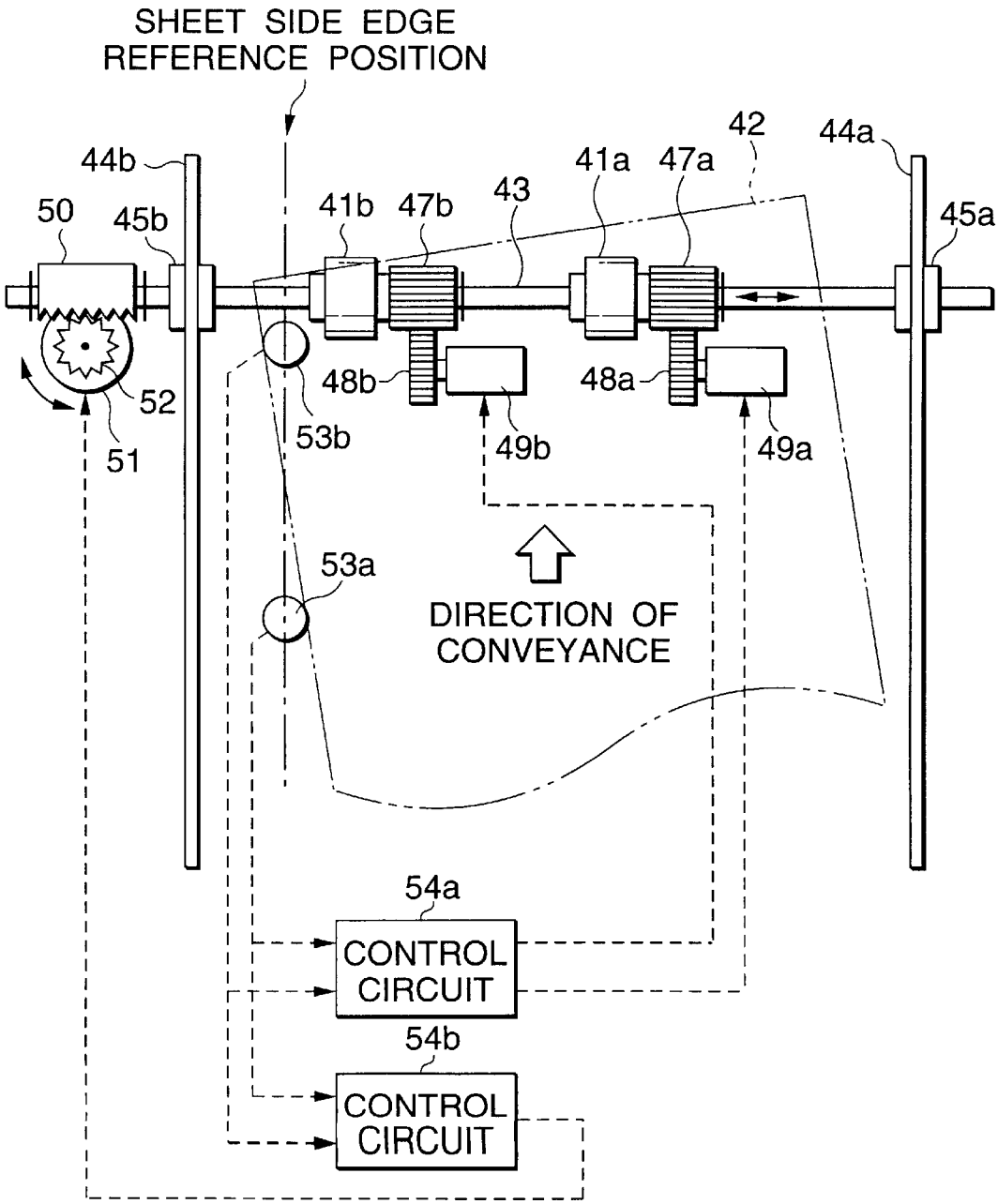
FIG. 5 is a schematic representation showing the configuration of a sheet alignment device according to a third embodiment of the present invention.

FIG. 5 is a schematic representation showing a sheet alignment device in accordance with a third embodiment of the present invention. In FIG. 5, conveyor rollers 41*a*, 41*b* are disposed in different positions in a direction intersecting the direction in which a sheet 42 is conveyed (i.e., a direction designated by arrow in FIG. 5). The conveyor rollers 41*a* and 41*b* are fixed to a rotary shaft 43. The rotary shaft 43 is supported at both ends by shaft bearings 45*a*, 45*b* in such a way as to be rotatable with respect to frames 44*a*, 44*b* and movable in a direction intersecting the direction of conveyance.

A drive gear 47*a* is fitted around the rotary shaft 43 in the vicinity of the conveyor roller 41*a*, and a drive gear 47*b* is fitted around the rotary shaft 43 in the vicinity of the conveyor roller 41*b*. Intermediate gears 48*a*, 48*b* mesh with the drive gears 47*a*, 47*b*. The intermediate gears 48*a*, 48*b* are attached to the respective rotary shafts of rotary drive motors 49*a*, 49*b* which rotatively drive the conveyor rollers 41*a*, 41*b*. A servo motor or stepping motor is used as the rotary drive motors 49*a*, 49*b*.

First and second sheet conveyor means which individually impart conveying force to the sheet 42 are constituted of the conveyor rollers 41*a*, 41*b*, the rotary shaft 43, the drive gears 47*a*, 47*b*, the intermediate gears 48*a*, 48*b*, the rotary drive motors 49*a*, 49*b*, and their peripheral members. The first and second sheet conveyor means can individually control the rotational speed of the conveyor rollers 41*a*, 41*b* by means of the rotary drive motors 49*a*, 49*b* and independently impart conveyance speed to the sheet 42. Accordingly, the sheet conveyor means also serve as sheet rotation means which rotates the sheet 42.

More specifically, when the conveyor rollers 41*a*, 41*b* rotate at the same speed, the foregoing elements act as the sheet conveyor means. However, when the conveyor roller 41*a* rotates faster than the conveyor roller 41*b*, the sheet 42 is rotated in a counterclockwise direction shown in FIG. 5. In contrast, when the conveyor roller 41*b* rotates faster than the conveyor roller 41*a*, the sheet 42 is rotated in a clockwise direction.

An axially-threaded gear 50 is attached to one end of the rotary shaft 43. The gear 50 meshes with a gear 52 attached to the rotary shaft of a shift motor 51. A DC motor is used as the shift motor 51. The shift motor 51 serves as a drive source used for moving the conveyor rollers 41*a*, 41*b* in a direction intersecting the direction of conveyance.

More specifically, the gears 52 is rotatively driven by means of the shift motor 51, and the rotational movement of the gear 52 is transmitted to the rotary shaft 43 via the gear 50 in the form of linear motion corresponding to the direction of rotation of the shift motor 51. As a result, the conveyor rollers 41*a*, 41*b* fixed to the rotary shaft 43 is actuated in the direction intersecting the direction of conveyance. Sheet shift means for shifting the sheet 42 is formed from the conveyor rollers 41*a*, 41*b*, the rotary shaft 43, the gear 50, the shift motor 51, the gear 52, and their peripheral members.

The conveyor rollers 41*a*, 41*b* pair up with driven rollers (not shown), and the sheet 42 is conveyed while being sandwiched between the conveyor rollers 41*a*, 41*b* and the driven rollers. The driven rollers are configured so as to be axially movable in association with the conveyor rollers 41*a*, 41*b* in order to facilitate the rotational movement or shift of the sheet 42. However, there is no necessity for configuring the driven rollers so as to be axially movable. If the driven roller is designed so as to be axially stationary, it is only essential that the driven rollers be formed from material, such as plastics, which is apt to cause slipping of the sheet 42.

Two sheet sensors 53*a*, 53*b* are disposed, as sheet side edge detection means for detecting the side edge of the sheet 42, in different positions in the direction of conveyance. The positions where the sheet sensors 53*a*, 53*b* are disposed are used as the reference position for the side edge of a sheet. An optical sensor comprising a light-emitting element and a light-receiving element in combination is used as the sheet sensors 53*a*, 53*b*.

Detection output signals from the respective sheet sensors 53*a*, 53*b* are supplied to control circuits 54*a*, 54*b*. On the basis of the result of detection by the sheet sensors 53*a*, 53*b*, the control circuit 54*a* controls the rotational speed of the rotary drive motors 49*a*, 49*b*. On the basis of the result of detection by the sheet sensors 53*a*, 53*b*, the control circuit 54*b* controls the direction in which the shift motor 51 is rotated; i.e., the direction in which the conveyor rollers 41*a*, 41*b* are shifted. The specific control logic of the control circuits 54*a*, 54*b* is provided in Table 3.

TABLE 3

| | DETECTION RESULT | | CONTROL | | |
|---|---|---|---|---|---|
| | 53a | 53b | 49a | 49b | 51 |
| case 1 | PAPER EMPTY | PAPER EMPTY | STANDARD SPEED | STANDARD SPEED | ROTATE THE MOTOR C.C.W. |
| case 2 | PAPER DETECTED | PAPER DETECTED | STANDARD SPEED | STANDARD SPEED | ROTATE THE MOTOR C.W. |
| case 3 | PAPER DETECTED | PAPER EMPTY | HIGH SPEED | STANDARD SPEED | STOP |
| case 4 | PAPER EMPTY | PAPER DETECTED | STANDARD SPEED | HIGH SPEED | STOP |

More specifically, when neither the sheet sensor 53*a* nor 53*b* detects the side edge of the sheet 42; i.e., paper empty (case 1), the control circuit 54*a* rotates the shift motors 49*a*, 49*b* at standard speed when receiving detection output signals from the respective sheet sensors 53*a*, 53*b*. Further, the control circuit 54*b* rotates the shift motor 51 in a counterclockwise direction shown in FIG. 5. As a result, the rotary shaft 43 is shifted in a leftward direction shown in FIG. 5, thereby shifting the sheet 42 in parallel with the direction of conveyance to the position where the sheet sensors 53*a*, 53*b* detect the side edge of the sheet 42 by way of the conveyor rollers 41*a*, 41*b*.

When both the sheet sensors 53*a*, 53*b* detect the side edge of the sheet 42; i.e., in the case of paper being detected (case 2), the control circuit 54*a* rotatively drives the rotary drive motors 49*a*, 49*b* at standard speed when receiving the detection output signals from the respective sheet sensors 53*a*, 53*b*. Further, the control circuit 54*b* rotates the shift motor 51 in a clockwise direction shown in FIG. 5. As a result, the rotary shaft 43 is shifted in a rightward direction shown in FIG. 5, whereby the sheet 42 is shifted by way of the conveyor rollers 41*a*, 41*b* to the position where the sheet sensors 53*a*, 53*b* do not detect the side edge of the sheet 42.

When the sheet sensor 53*a* detects the side edge of the sheet 42; i.e., in the case of paper being detected, and the sheet sensor 53*b* does not detect the side edge of the sheet 42; i.e., paper empty (case 3), the control circuit 54*a* rotatively drives the rotary drive motor 49*a* at high speed and the rotary drive motor 49*b* at standard speed when receiving the detection output signals from the respective sheet sensors 53*a*, 53*b*. In this case, the control circuit 54*b* stops the shift motor 51. As a result, the conveyor roller 41*a* rotates faster than the conveyor roller 41*b*, whereby the sheet 42 is rotated in a counterclockwise direction shown in FIG. 5.

When the sheet sensor 53*a* does not detect the side edge of the sheet 42; i.e., paper empty, and the sheet sensor 53*b* detects the side edge of the sheet 42; i.e., in the case of paper being detected (case 4), the control circuit 54*a* rotatively drives the rotary drive motor 49*a* at standard speed and the rotary drive motor 49*b* at high speed when receiving the detection output signals from the respective sheet sensors 53*a*, 53*b*. Even in this case, the control circuit 54*b* stops the shift motor 51. As a result, the conveyor roller 41*b* rotates faster than the conveyor roller 41*a*, the sheet 42 is rotated in a clockwise direction shown in FIG. 5.

Figure 6:
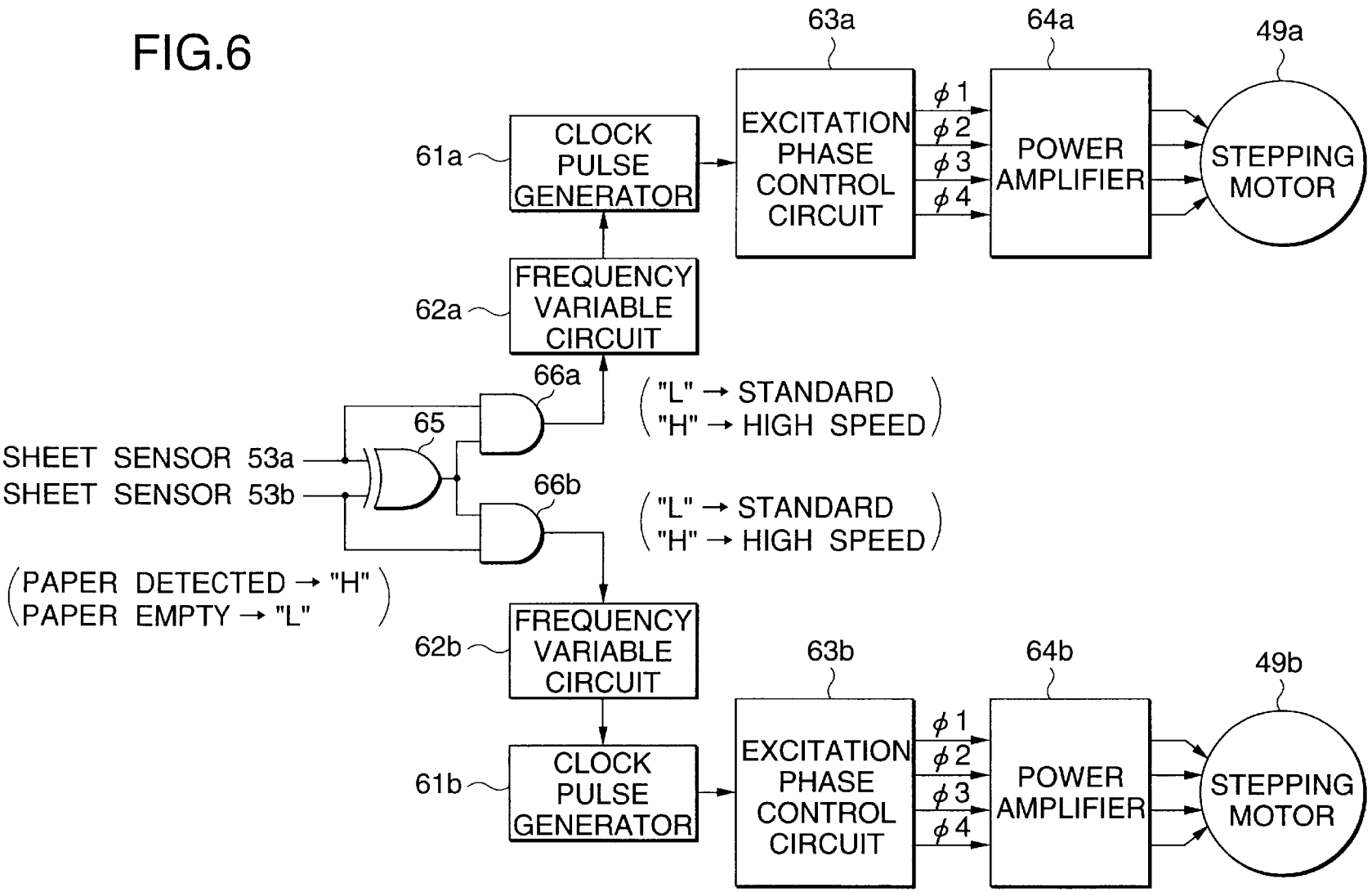
FIG. 6 is a block diagram showing one example of the configuration of a control circuit according to the third embodiment.

FIG. 6 is a circuit diagram showing one example of the configuration of the control circuit 54*a* in a case where a stepping motor is used as example of the rotary drive motors 49*a*, 49*b*. The stepping motor used as the rotary drive motors 49*a*, 49*b* has the following characteristics; namely, the overall angle of rotation of the stepping motor is proportional to a total number of input pulses, and the rotational speed of the stepping motor is in proportion to a pulse rate of the input pulse signal.

In FIG. 6, a drive system of the rotary drive motor 49*a* comprises a clock pulse generator 61*a* for producing a pulse signal at given periods; a frequency variable circuit 62*a* which changes the frequency of a pulse signal generated by the clock pulse generator 61*a*; an excitation phase control circuit 63*a* which distributes a drive signal to each of excitation phases (for an exciting coil) of a stepping motor in accordance with a pulse signal received from the clock pulse generator 61*a*; and a power amplification circuit 64*a* which drives the motor 49*a* while amplifying an exciting current, as required. A drive system of the rotary drive motor 49*b* comprises a clock pulse generator 61*b* for producing a pulse signal at given periods; a frequency variable circuit 62*b* which changes the frequency of a pulse signal generated by the clock pulse generator 61*b*; an excitation phase control circuit 63*b* which distributes a drive signal to each of excitation phases (for an exciting coil) of a stepping motor in accordance with a pulse signal received from the clock pulse generator 61*b*; and a power amplification circuit 64*b* which drives the motor 49*b* while amplifying an exciting current, as required.

The detection signals output from the two sheet sensors 53*a*, 53*b* are received by two input terminals of an EX-OR (exclusive OR) circuit 65. Further, the detection signal output from the sheet sensor 53*a* is received by one of two input terminals of a two-input AND (logic) circuit 66*a*, and the detection signal output from the sheet sensor 53*b* is received by one of two input terminals of a two-input AND (logic) circuit 66*b*. An output from the EX-OR circuit 65 is received by the other input terminal of each of the AND circuits 66*a*, 66*b*. An output from the AND circuit 66*a* is received by the frequency variable circuit 62*a*, and an output from the AND circuit 66*b* is received by the frequency variable circuit 62*b*. According to the logic levels of the outputs from the AND circuits 66*a*, 66*b*, the frequency variable circuits 62*a*, 62*b* switch in two levels the frequencies of the pulse signals generated by the respective clock pulse generators 61*a*, 61*b*.

Provided that the two sheet sensors 53*a*, 53*b* produce a high-level output when there is a sheet and produces a low-level output when there is no sheet, the EX-OR circuit 65 outputs a low-level signal if neither the sheet sensor 53*a* nor 53*b* detects a sheet (case 1) or both the sheet sensors 53*a* and 53*b* detect a sheet (case 2). As a result, the AND circuits 66*a*, 66*b* produce low-level outputs, and hence the frequency variable circuits 62*a*, 62*b* set the frequencies of the respective pulse signals produced by the clock pulse generators 61*a*, 61*b* to a frequency corresponding to standard speed.

In a case where the sheet sensor 53*a* detects the sheet, and the sheet sensor 53*b* does not detect the sheet (case 3), the output from the EX-OR circuit 65 becomes high, and the output from the AND circuit 66*a* becomes high. However, the output from the AND circuit 66*b* becomes low. As a result, the frequency variable circuit 62*a* sets the frequency of the pulse signal generated by the clock pulse generator 61*a* to a frequency corresponding to a high speed mode. In contrast, the frequency variable circuit 62*b* maintains the frequency of the pulse signal generated by the clock pulse generator 61*b* at a frequency corresponding to a standard speed mode.

In a case where the sheet sensor 53*a* detects no sheet, and the sheet sensor 53*b* detects the sheet (case 4), the output from the EX-OR circuit 65 becomes high, and the output from the AND circuit 66*a* becomes low. Further, the output from the AND circuit 66*b* becomes high. As a result, the frequency variable circuit 62*a* sets the frequency of the pulse signal generated by the clock pulse generator 61*a* to a frequency corresponding to a normal speed mode. In contrast, the frequency variable circuit 62*b* maintains the frequency of the pulse signal generated by the clock pulse generator 61*b* at a frequency corresponding to a high speed mode.

As mentioned previously, in a case where any one of the two sheet sensors 53*a*, 53*b* detects the side edge of the sheet 42, or where there is a mismatch between the detection results output from the sheet sensors 53*a*, 53*b*, the rotational speed of the rotary drive motors (stepping motors) 49*a*, 49*b* can be switched between a normal speed mode and a high speed mode by switching the frequencies of the pulse signals produced by the clock pulse generators 61*a*, 61*b* on the basis of the respective detection results output from the sheet sensors 53*a*, 53*b*.

The control circuit 54*b* for controlling the shift motor 51 is basically the same in configuration as the control circuit 34 employed in the second embodiment. Consequently, an explanation of the control circuit 54*b* will be omitted here.

As is evident from Table 3, in the third embodiment, it is necessary to control the direction in which the shift motor 51 is rotated when both the sheet sensors 53*a*, 53*b* detect the sheet 42 or when neither the sheet sensor 53*a* nor 53*b* detects the sheet 42. It is only essential that a source voltage be supplied from a d.c. source E31 only when there is a match between the detection results output from the sheet sensors 53*a*, 53*b*. At this time, since the detection results output from the sheet sensors 53*a*, 53*b* are in the same logic level. Accordingly, it is only required to provide the control circuit 54*b* with, as a control input signal, either the detection result output from the sheet sensor 53*a* or the detection result output from the sheet sensor 53*b*.

As mentioned previously, in the sheet alignment device according to the third embodiment, the conveyor rollers 41*a*, 41*b* driven by the rotary drive motors 49*a*, 49*b* are disposed in different positions in a direction intersecting the direction of conveyance and independently impart a conveying speed to the sheet 42. The sheet sensors 53*a*, 53*b* are placed in the sheet side edge reference position, and the rotary drive motor 49*a* is driven at high speed when only the sheet detection sensor 53*a* detects the sheet 42. In contrast, when only the sheet sensor 53*b* detects the sheet 42, both skew and side misregistration of the sheet 42 can be corrected while the sheet is being conveyed by driving the rotary drive motor 49*b* at high speed.

The conveyor rollers 41*a*, 41*b* are arranged so as to be movable in a direction intersecting the direction of conveyance by the sheet shift means that employs the shift motor 51 as a drive source. When neither the sheet sensor 53*a* nor the sheet sensor 53*b* detects the side edge of the sheet 42, the shift motor 51 is controlled so as to shift the conveyor rollers 41*a*, 41*b* to the sheet side edge reference position. In contrast, when both the sheet sensors 53*a* and 53*b* detect the side edge of the sheet, the shift motor 51 is controlled in such a way that the conveyor rollers 41*a* and 41*b* depart from the sheet side edge reference position. As a result, the sheet 42 can be shifted in parallel with the direction of conveyance while being conveyed. If the sheet 42 is conveyed to a position extremely spaced apart from the sheet side edge reference position, the sheet 42 can be shifted to the sheet side edge reference position in parallel with the direction of conveyance by means of the foregoing shifting capability. Consequently, skew and side misregistration of the sheet can be quickly corrected.

It is only necessary for the control circuits 54*a*, 54*b* to control, on the basis of the result of detection by the sheet sensors 53*a*, 53*b*, the rotational speed of the rotary drive motors 49*a*, 49*b* and the direction in which the shift motor 51 is driven. The control circuits 54*a*, 54*b* do not require any arithmetic operation. Therefore, as in the first embodiment, the control circuits 54*a*, 54*b* can be configured from simple electronic circuits. The conveyor rollers 41*a*, 41*b* are returned to their original positions (e.g., the intermediate positions within the extent to which the conveyor rollers 41*a*, 41*b* can be moved).

Figure 7:
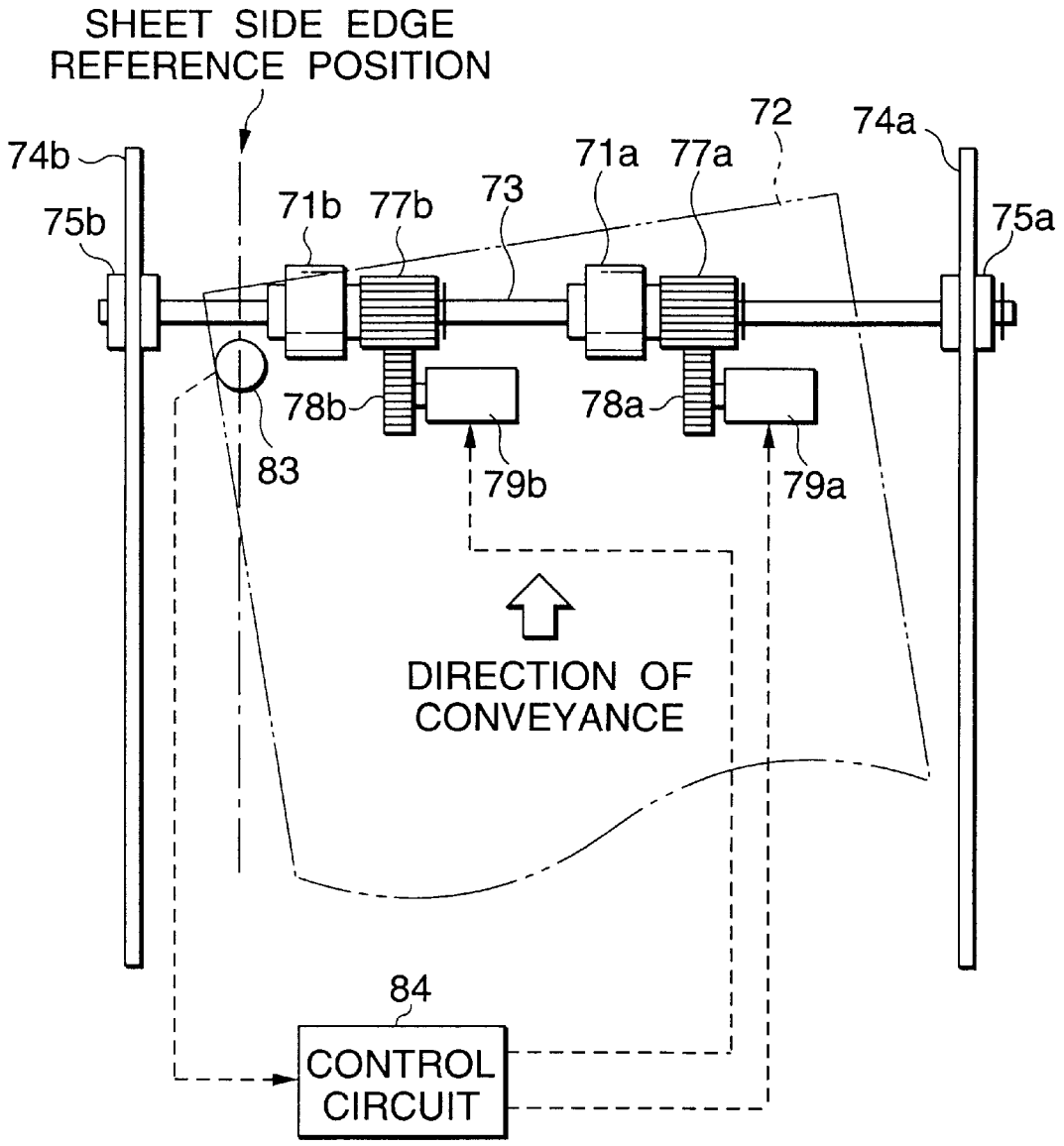
FIG. 7 is a schematic representation showing the configuration of a sheet alignment device according to a fourth embodiment of the present invention.

FIG. 7 is a schematic representation showing a sheet alignment device in accordance with a fourth embodiment of the present invention. In FIG. 7, conveyor rollers 71*a*, 71*b* are disposed in different positions in a direction intersecting the direction in which a sheet 72 is conveyed (i.e., a direction designated by arrow in FIG. 7). The conveyor rollers 71*a* and 71*b* are fixed to a rotary shaft 73. The rotary shaft 73 is supported at both ends by shaft bearings 75*a*, 75*b* in such a way as to be rotatable with respect to frames 74*a*, 74*b* and movable in a direction intersecting the direction of conveyance.

A drive gear 77*a* is fitted around the rotary shaft 73 in the vicinity of the conveyor roller 71*a*, and a drive gear 77*b* is fitted around the rotary shaft 73 in the vicinity of the conveyor roller 71*b*. Intermediate gears 78*a*, 78*b* mesh with the drive gears 77*a*, 77*b*. The intermediate gears 78*a*, 78*b* are attached to the respective rotary shafts of rotary drive motors 79*a*, 79*b* which rotatively drive the conveyor rollers 71*a*, 71*b*. A servo motor or stepping motor is used as the rotary drive motors 79*a*, 79*b*.

First and second sheet conveyor means which individually impart conveying force to the sheet 72 are constituted of the conveyor rollers 71*a*, 71*b*, the rotary shaft 73, the drive gears 77*a*, 77*b*, the intermediate gears 78*a*, 78*b*, the rotary drive motors 79*a*, 79*b*, and their peripheral members. The first and second sheet conveyor means can individually control the rotational speed of the conveyor rollers 71*a*, 71*b* by means of the rotary drive motors 79*a*, 79*b* and independently impart conveyance speed to the sheet 72. Accordingly, the sheet conveyor means also serve as sheet rotation means which rotates the sheet 72.

More specifically, when the conveyor rollers 71*a*, 71*b* rotate at the same speed, the foregoing elements act as the sheet conveyor means. However, when the conveyor roller 71*a* rotates faster than the conveyor roller 71*b*, the sheet 72 is rotated in a counterclockwise direction shown in FIG. 7. In contrast, when the conveyor roller 71*b* rotates faster than the conveyor roller 71*a*, the sheet 72 is rotated in a clockwise direction.

A single sheet sensor 83 is disposed in the vicinity of the frame 74*b* as sheet side edge detection means for detecting the side edge of the sheet 72. The position where the sheet sensor 83 is disposed is used as the reference position for the side edge of a sheet. An optical sensor comprising a light-emitting element and a light-receiving element in combination is used as the sheet sensor 83. A detection output signal from the sheet sensor 83 is supplied to a control circuit 84. On the basis of the result of detection by the sheet sensor 83, the control circuit 84 controls the rotational speed of rotary drive motors 79*a*, 79*b*. The specific control logic of the control circuits 54*a*, 54*b* is provided in Table 4.

TABLE 4

| | DETECTION RESULT | CONTROL | |
|---|---|---|---|
| | 83 | 79a | 79b |
| case 1 | PAPER DETECTED | HIGH SPEED | STANDARD SPEED |
| case 2 | PAPER EMPTY | STANDARD SPEED | HIGH SPEED |

More specifically, when the sheet sensor 83 detects the side edge of the sheet 72; i.e., in the case of paper being detected (case 1), the control circuit 84 rotatively drives the rotary drive motor 79*a* at high speed and the rotary drive motor 79*b* at standard speed when receiving the detection output signal from the sheet sensor 83. As a result, the conveyor roller 71*a* conveys the sheet faster than the conveyor roller 71*b*, whereby the sheet 72 is rotated in a counterclockwise direction while being conveyed.

When the sheet sensor 83 does not detect the side edge of the sheet 72; i.e., paper empty (case 2), the control circuit 84 rotatively drives the rotary drive motor 79*a* at standard speed and the rotary drive motor 79*b* at high speed when receiving the detection output signal from the sheet sensor 83. As a result, the conveyor roller 71*b* conveys the sheet faster than the conveyor roller 71*a*, whereby the sheet 72 is rotated in a clockwise direction shown in FIG. 7.

Figure 8:
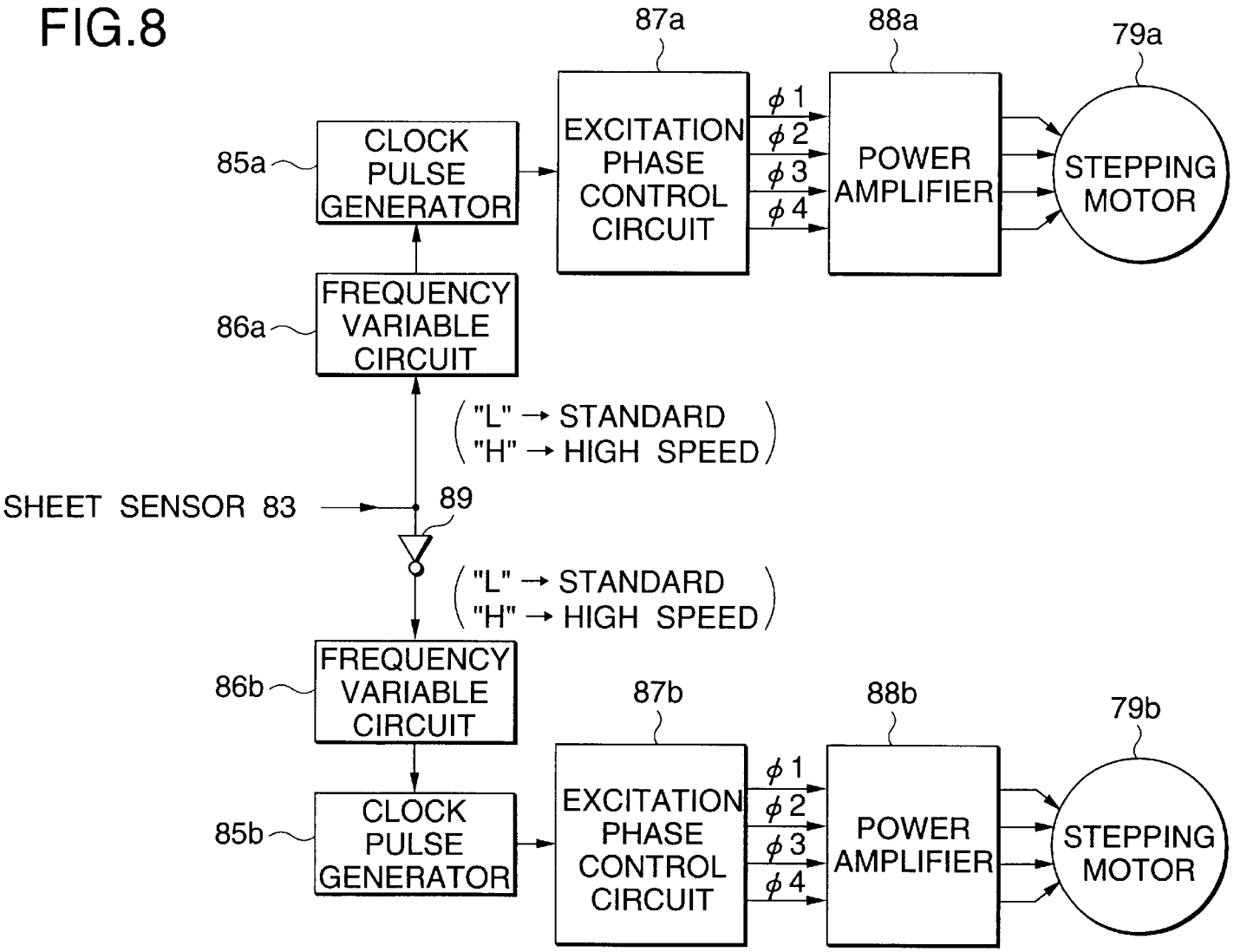
FIG. 8 is a block diagram showing one example of the configuration of a control circuit according to the fourth embodiment.

FIG. 8 is a circuit diagram showing one example of the configuration of the control circuit 84 in a case where a stepping motor is used as example of the rotary drive motors 79*a*, 79*b*. In FIG. 8, as in the third embodiment, a drive system of the rotary drive motor 79*a* comprises a clock pulse generator 85*a* for producing a pulse signal at given periods; a frequency variable circuit 86*a* which changes the frequency of a pulse signal generated by the clock pulse generator 85*a*; an excitation phase control circuit 86*a* which distributes a drive signal to each of excitation phases (for an exciting coil) of a stepping motor in accordance with a pulse signal received from the clock pulse generator 85*a*; and a power amplification circuit 87*a* which drives the motor 79*a* while amplifying an exciting current, as required. A drive system of the rotary drive motor 79*b* comprises a clock pulse generator 85*b* for producing a pulse signal at given periods; a frequency variable circuit 86*b* which changes the frequency of a pulse signal generated by the clock pulse generator 85*b*; an excitation phase control circuit 86*b* which distributes a drive signal to each of excitation phases (for an exciting coil) of a stepping motor in accordance with a pulse signal received from the clock pulse generator 85*b*; and a power amplification circuit 87*b* which drives the motor 79*b* while amplifying an exciting current, as required.

The detection signal output from the sheet sensor 83 is directly supplied to the frequency variable circuit 86*a* connected to the rotary drive motor 79*a*. At the same time, the detection signal is directly supplied to the frequency variable circuit 86*b* connected to the rotary drive motor 79*b* after having been inverted by an inverter 89.

The sheet sensor 83 produces a high-level detection output signal when the sheet is detected and produces a low-level detection output signal when the sheet is not detected.

In the case of the sheet being detected (case 1) in Table 4, a high-level signal is supplied to the frequency variable circuit 86*a*, and a low-level signal is supplied to the frequency variable circuit 86*b*. As a result, the frequency variable circuit 86*a* sets the frequency of the pulse signal generated by the clock pulse generator 85*a* to a frequency corresponding to a high speed mode. In contrast, the frequency variable circuit 86*b* sets the frequency of the pulse signal generated by the clock pulse generator 85*b* at a frequency corresponding to a standard speed mode.

In the case of paper empty (case 2), a low-level signal is supplied to the frequency variable circuit 86*a*, and a high-level signal is supplied to the frequency variable circuit 86*b*. As a result, the frequency variable circuit 86*a* sets the frequency of the pulse signal generated by the clock pulse generator 85*a* to a frequency corresponding to a standard speed mode. In contrast, the frequency variable circuit 86*b* sets the frequency of the pulse signal generated by the clock pulse generator 85*b* at a frequency corresponding to a high speed mode.

As mentioned previously, in the sheet alignment device according to the fourth embodiment, the conveyor rollers 71*a*, 71*b* driven by the rotary drive motors 79*a*, 79*b* are disposed in different positions in a direction intersecting the direction of conveyance and independently impart a conveying speed to the sheet 72. The single sheet sensor 83 is placed in the sheet side edge reference position. When the sheet detection sensor 83 detects the sheet 72, the rotary drive motor 79*a* is driven at high speed, and the rotary drive motor 79*b* is driven at standard speed. In contrast, when the sheet sensor 83 does not detect the sheet 72, the rotary drive motor 79*a* is driven at standard speed, and the rotary drive motor 79*b* is driven at high speed. Both skew and side misregistration of the sheet 72 can be corrected while the sheet is being conveyed by driving the rotary drive motor 79*b* at high speed.

In comparison with the third embodiment, the sheet alignment device has only sheet detection system and does not have any sheet shift means. Accordingly, it takes a little time to correct skew and side misregistration of the sheet. Further, if the sheet 72 is conveyed to a position extremely spaced apart from the side edge reference position, it takes a time to commence correcting skew and side misregistration of the sheet. However, there is no need to provide the sheet alignment device with more than two sheet sensors 83, and the sheet alignment device does not require sheet shift means. Therefore, the sheet alignment device has the advantage of inexpensive configuration. Further, it is only necessary for the control circuit 84 to control the rotational speed of the rotary drive motors 79*a*, 79*b* on the basis of the result of detection by the sheet sensor 83, and the control circuit 84 does not need any arithmetic operation. For this reason, there arises another advantage of enabling formation of the control circuit 84 from simple electronic circuits.

Figure 9:
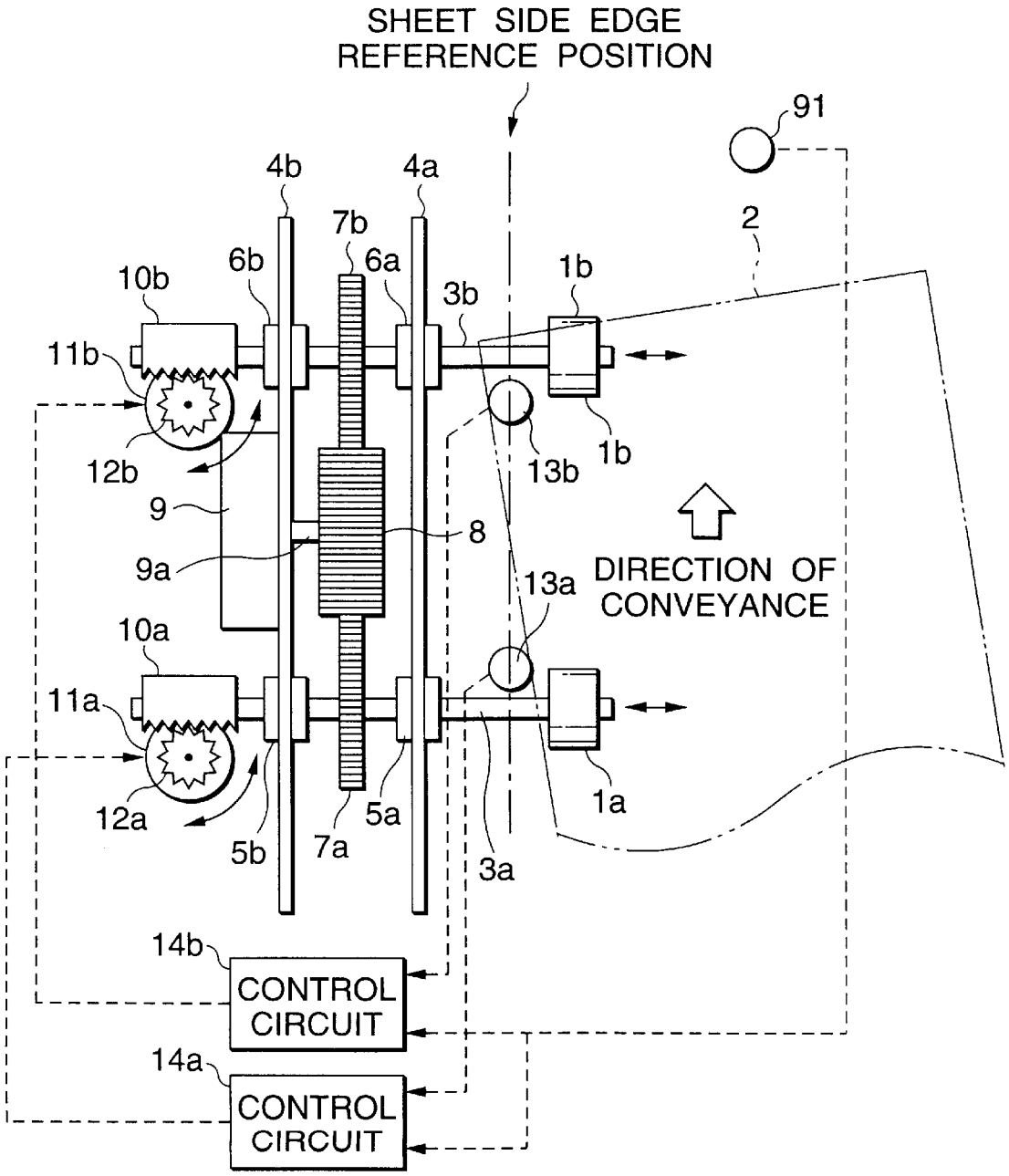
FIG. 9 is a schematic representation showing the configuration of a sheet alignment device according to a fifth embodiment of the present invention.

FIG. 9 is a schematic representation showing a sheet alignment device according to a fifth embodiment of the present invention. The sheet alignment device according to the present embodiment is basically the same as that used in the first embodiment. In the drawing, the elements which are the same as those shown in FIG. 1 are assigned the same reference numerals. The present embodiment is different from the first embodiment in that a sheet sensor 91 is disposed in a forward position in the direction of conveyance, and that the control circuits 14*a*, 14*b* control the direction in which the shift motors 11*a*, 11*b* are rotated on the basis of the detection output signals from the sheet sensors 13*a*, 13*b*, and 91. Specific control logic of the control circuits 14*a*, 14*b* is provided in Table 5.

TABLE 5

| | DETECTION RESULT | | CONTROL |
|---|---|---|---|
| | 13a/13b | 91 | 11a/11b |
| case 1 | PAPER EMPTY | PAPER EMPTY | ROTATE MOTORS AT HIGH SPEED C.C.W. |
| case 2 | PAPER DETECTED | | ROTATE MOTORS AT HIGH SPEED C.W. |
| case 3 | PAPER EMPTY | PAPER DETECTED | ROTATE MOTORS AT LOW SPEED C.C.W. |
| case 4 | PAPER DETECTED | | ROTATE MOTORS AT LOW SPEED C.W. |

As is evident from Table 5, the control circuits 14*a*, 14*b* operate completely in the same manner on the basis of the respective detection signals output from the sheet sensors 13*a*, 13*b*. Therefore, an explanation will be given solely of the control circuit 14*a*. First, in a case where the sheet detection sensor 91 does not detect the sheet 2 (i.e., paper empty), when the sheet sensor 13*a* does not detect the side edge of the sheet 2 (i.e., paper empty) (case 1), the control circuit 14*a* drives the shift motor 11*a* at high speed in a counterclockwise direction when receiving the detection output signal from the sheet detection sensor 13*a*. As a result, the rotary shaft 3*a* is moved at high speed in a leftward direction shown in FIG. 9, to thereby move the sheet 2 to a position where the sheet sensor 13*a* detects the side edge of the sheet 2, by way of the conveyor roller 1*a*.

Similarly, in a case where the sheet detection sensor 91 does not detect the sheet 2 (i.e., paper empty), when the sheet sensor 13*a* detects the side edge of the sheet 2 (i.e., when paper is detected) (case 2), the control circuit 14*a* drives the shift motor 11*a* at high speed in a clockwise direction when receiving the detection output signal from the sheet detection sensor 13*a*. As a result, the rotary shaft 3*a* is moved at high speed in a rightward direction shown in FIG. 9, to thereby move the sheet 2 to a position where the sheet sensor 13*a* detects the side edge of the sheet 2, by way of the conveyor roller 1*a*.

In a case where the sheet detection sensor 91 detects the sheet 2 (i.e., in the case of paper being detected), when the sheet sensor 13*a* does not detect the side edge of the sheet 2 (i.e., paper empty) (case 3), the control circuit 14*a* drives the shift motor 11*a* at low speed in a counterclockwise direction when receiving the detection output signal from the sheet detection sensor 13*a*. As a result, the rotary shaft 3*a* is moved at low speed in a leftward direction shown in FIG. 9, to thereby move the sheet 2 to a position where the sheet sensor 13*a* detects the side edge of the sheet 2, by way of the conveyor roller 1*a*.

Similarly, in a case where the sheet detection sensor 91 detects the sheet 2 (i.e., in the case of paper being detected), when the sheet sensor 13*a* detects the side edge of the sheet 2 (i.e., when paper is detected) (case 4), the control circuit 14*a* drives the shift motor 11*a* at low speed in a clockwise direction when receiving the detection output signal from the sheet detection sensor 13*a*. As a result, the rotary shaft 3*a* is moved at low speed in a rightward direction shown in FIG. 9, to thereby move the sheet 2 to a position where the sheet sensor 13*a* detects the side edge of the sheet 2, by way of the conveyor roller 1*a*.

The control circuits 14*a*, 14*b* that perform the foregoing control operations are basically the same as those in the first embodiment. However, in view of the need to switch the rotational speed of the shift motors 11*a*, 11*b* between a low-speed mode and a high-speed mode according to whether or not the sheet sensor 91 detects the sheet 2 (i.e., whether or not paper exists), the fifth embodiment is different from the first embodiment. For this reason, it is only essential that the supply voltages supplied from the d.c. power sources E11, E21 in the circuit configuration shown in FIG. 2 be switched in two levels according to the detection output signal from the sheet sensor 91.

As mentioned previously, the sheet alignment device according to the fifth embodiment has the sheet sensor 91 disposed in a forward position in the direction in which the sheet 2 is conveyed, as well as the configuration of the sheet alignment device in the first embodiment. Further, the rotational speed of the shift motors 11*a*, 11*b* is switched between a low-speed mode and a high-speed mode on the basis of the detection output signal from the sheet sensor 91. In a case where the sheet sensor 91 does not detect the sheet 2, the skew and side misregistration of the sheet are corrected at high speed. In contrast, in a case where the sheet sensor 91 detects the sheet 2, the skew and side misregistration of the sheet are again corrected at low speed. As a result, the skew and side misregistration of the sheet can be corrected faster in comparison with the correction of skew and side misregistration of the sheet performed in the first embodiment. Accordingly, the positional accuracy of the sheet can be improved to a much greater extent.

Although the fifth embodiment has been described with reference to the sheet alignment device configured on the basis of the first embodiment, the sheet alignment device according to the fifth embodiment can also be configured on the basis of the sheet alignment device according to the second embodiment.

Figure 10:
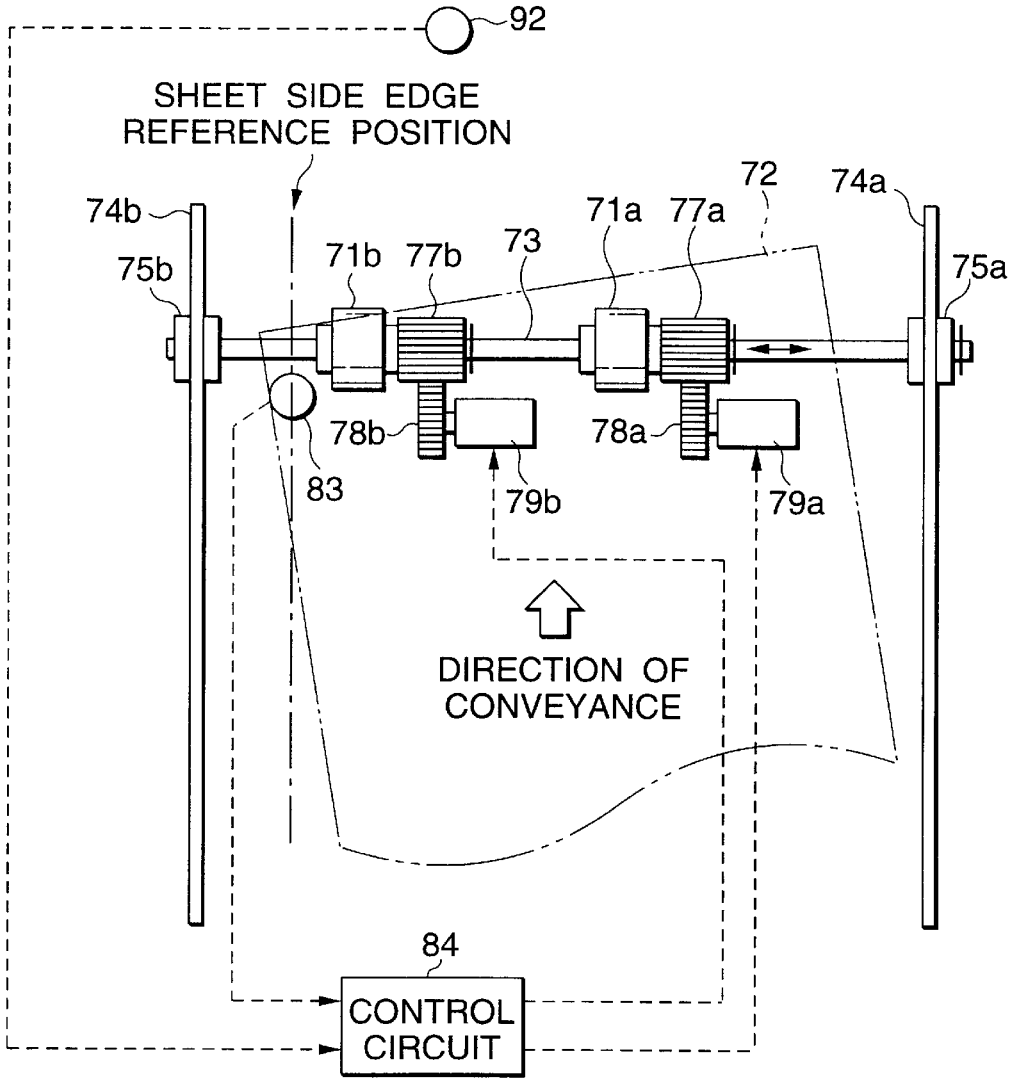
FIG. 10 is a schematic representation showing the configuration of a sheet alignment device according to a sixth embodiment of the present invention.

FIG. 10 is a schematic representation showing a sheet alignment device according to a sixth embodiment of the present invention. The sheet alignment device according to the present embodiment is basically the same as that used in the fourth embodiment. In the drawing, the elements which are the same as those shown in FIG. 7 are assigned the same reference numerals. The present embodiment is different from the fourth embodiment in that a sheet sensor 92 is disposed in a forward position in the direction of conveyance, and that the control circuit 84 controls the rotational speed of the rotary drive motors 79*a*, 79*b* on the basis of the detection output signals from the sheet sensors 83 and 92.

The control circuit 84 is configured so as to be able to control the rotational speed of the rotary drive motors 79*a*, 79*b* in three levels; namely, standard speed/intermediate speed/high speed. The relation between these speeds is expressed by standard speed<intermediate speed<high speed. In the present embodiment, the intermediate speed corresponds to the high speed in the fourth embodiment. Specific control logic of the control circuit 84 is provided in Table 6.

TABLE 6

| | DETECTION RESULT | | CONTROL | |
|---|---|---|---|---|
| | 83 | 92 | 79a | 79b |
| case 1 | PAPER DE-TECTED | PAPER EMPTY | HIGH SPEED | STANDARD SPEED |
| case 2 | PAPER EMPTY | | STANDARD SPEED | HIGH SPEED |
| case 3 | PAPER DE-TECTED | PAPER DE-TECTED | INTERMEDIATE SPEED | STANDARD SPEED |
| case 4 | PAPER EMPTY | | STANDARD SPEED | INTERMEDIATE SPEED |

In a case where a sheet detection sensor 92 does not detect the sheet 72 (i.e., paper empty), when the sheet sensor 83 detects the side edge of the sheet 72 (i.e., when paper is detected) (case 1), the control circuit 84 drives the rotary drive motor 79*a* at high speed and the rotary drive motor 79*b* at standard speed when receiving the detection output signal from the sheet detection sensor 83. As a result, the conveyor roller 71*a* rotates much faster than the conveyor roller 71*b*, whereby the sheet 72 is rotated at high speed in a counterclockwise direction shown in FIG. 10 while being conveyed.

In contrast, in a case where a sheet detection sensor 83 does not detect the sheet 72 (i.e., paper empty) (case 2), the control circuit 84 drives the rotary drive motor 79*a* at standard speed and the rotary drive motor 79*b* at high speed when receiving the detection output signal from the sheet detection sensor 83. As a result, the conveyor roller 71*b* rotates much faster than the conveyor roller 71*a*, whereby the sheet 72 is rotated at high speed in a clockwise direction shown in FIG. 10 while being conveyed.

In a case where a sheet detection sensor 92 detects the sheet 72 (i.e., in the case of paper being detected), when the sheet sensor 83 detects the side edge of the sheet 72 (i.e., when paper is detected) (case 3), the control circuit 84 drives the rotary drive motor 79*a* at intermediate speed and the rotary drive motor 79*b* at standard speed when receiving the detection output signal from the sheet detection sensor 83. As a result, the conveyor roller 71*a* rotates much faster than the conveyor roller 71*b*, whereby the sheet 72 is rotated at low speed in a counterclockwise direction shown in FIG. 10 while being conveyed.

Similarly, in a case where a sheet detection sensor 83 does not detect the sheet 72 (i.e., paper empty) (case 2), the control circuit 84 drives the rotary drive motor 79*a* at standard speed and the rotary drive motor 79*b* at high speed when receiving the detection output signal from the sheet detection sensor 83. As a result, the conveyor roller 71*b* rotates much faster than the conveyor roller 71*a*, whereby the sheet 72 is rotated at high speed in a clockwise direction shown in FIG. 10 while being conveyed.

Figure 11:
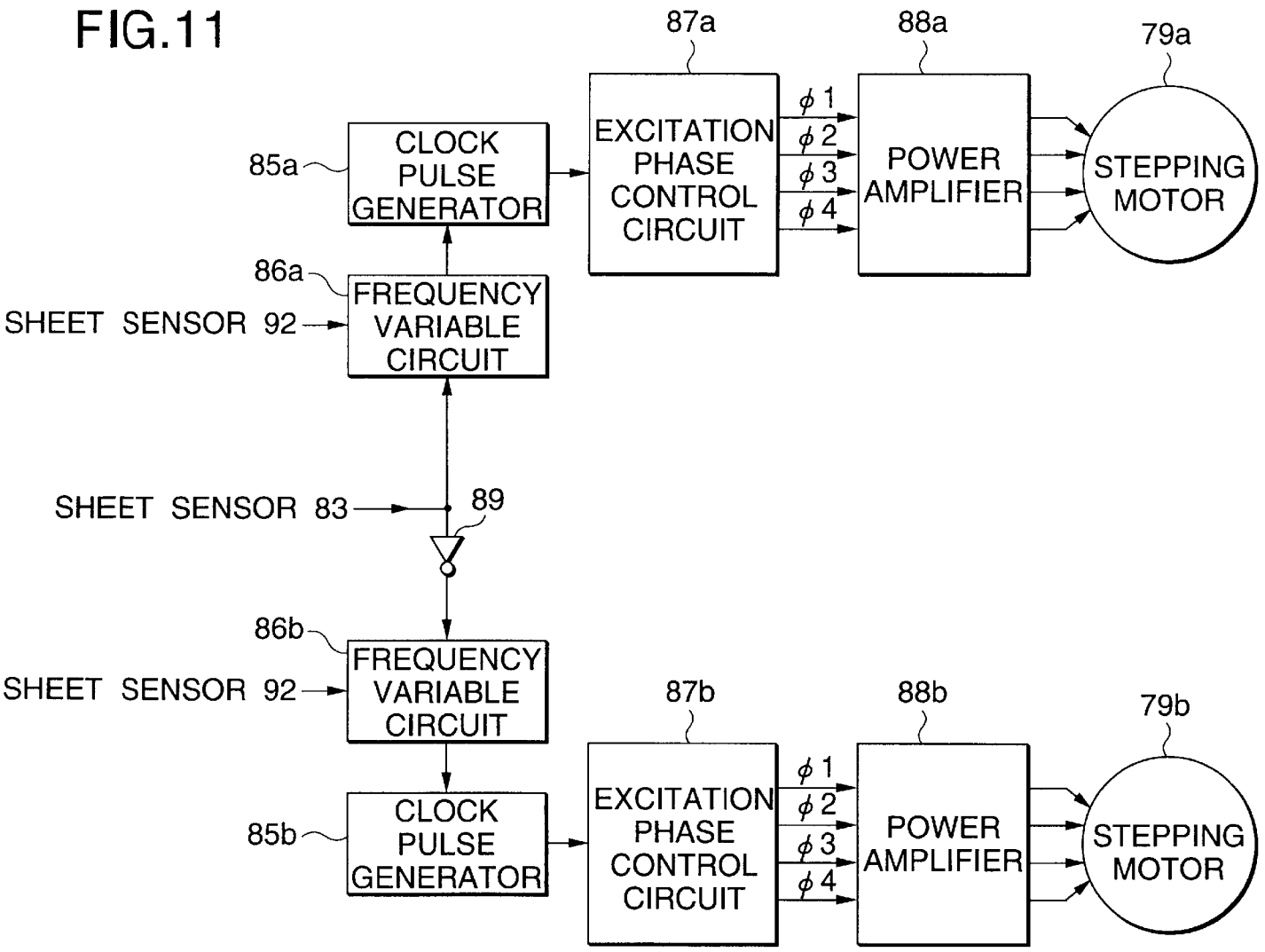
FIG. 11 is a block diagram showing one example of the configuration of a control circuit according to the sixth embodiment.

The control circuit 84 that performs the foregoing control operations is basically the same as that in the fourth embodiment. However, in view of the need to switch the rotational speed of the rotary drive motors 79*a*, 79*b* between a standard-speed mode, an intermediate-speed mode, and a high-speed mode according to whether or not the sheet sensor 92 detects the sheet 72 (i.e., whether or not paper exists), the sixth embodiment is different from the fourth embodiment. For this reason, as shown in FIG. 11, the detection output signal from the sheet sensor 92 is supplied to the frequency variable circuits 86*a*, 86*b*.

When receiving the detection output signal from the sheet sensor 92, the frequency variable circuits 86*a*, 86*b* switch the frequencies of the pulse signals generated by the clock pulse generators 85*a*, 85*b* according to the standard-speed mode/intermediate-speed mode. In contrast, when there is no input of the detection output signal from the sheet sensor 92, the frequency variable circuits 86*a*, 86*b* switch the frequencies of the pulse signals generated by the clock pulse generators 85*a*, 85*b* according to the standard-speed mode/high-speed mode.

As mentioned previously, the sheet alignment device according to the sixth embodiment has the sheet sensor 92 disposed in a forward position in the direction in which the sheet 72 is conveyed, as well as the configuration of the sheet alignment device in the fourth embodiment. Further, the rotational speed of the rotary drive motors 79*a*, 79*b* is switched between a standard-speed mode, an intermediate-speed mode, and a high-speed mode on the basis of the detection output signal from the sheet sensor 92. In a case where the sheet sensor 92 does not detect the sheet 72, the skew and side misregistration of the sheet are corrected at high speed. In contrast, in a case where the sheet sensor 92 detects the sheet 72, the skew and side misregistration of the sheet are again corrected at low speed. As a result, the skew and side misregistration of the sheet can be corrected faster in comparison with the correction of skew and side misregistration of the sheet performed in the fourth embodiment. Accordingly, the positional accuracy of the sheet can be improved to a much greater extent.

Although the sixth embodiment has been described with reference to the sheet alignment device configured on the basis of the fourth embodiment, the sheet alignment device according to the sixth embodiment can also be configured on the basis of the sheet alignment device according to the third embodiment.

Although the explanation has been given of the sheet alignment device according to the first to sixth embodiments with reference to a case where one sheet side edge reference position is set, and the sheet of each size is conveyed with reference to the sheet side edge reference position, the present invention is not limited to these embodiments. The present invention can also be applied to a sheet alignment device which is configured so as to convey the sheet of each size while the sheet is constantly placed in the center of a conveyance path.

Figure 12:
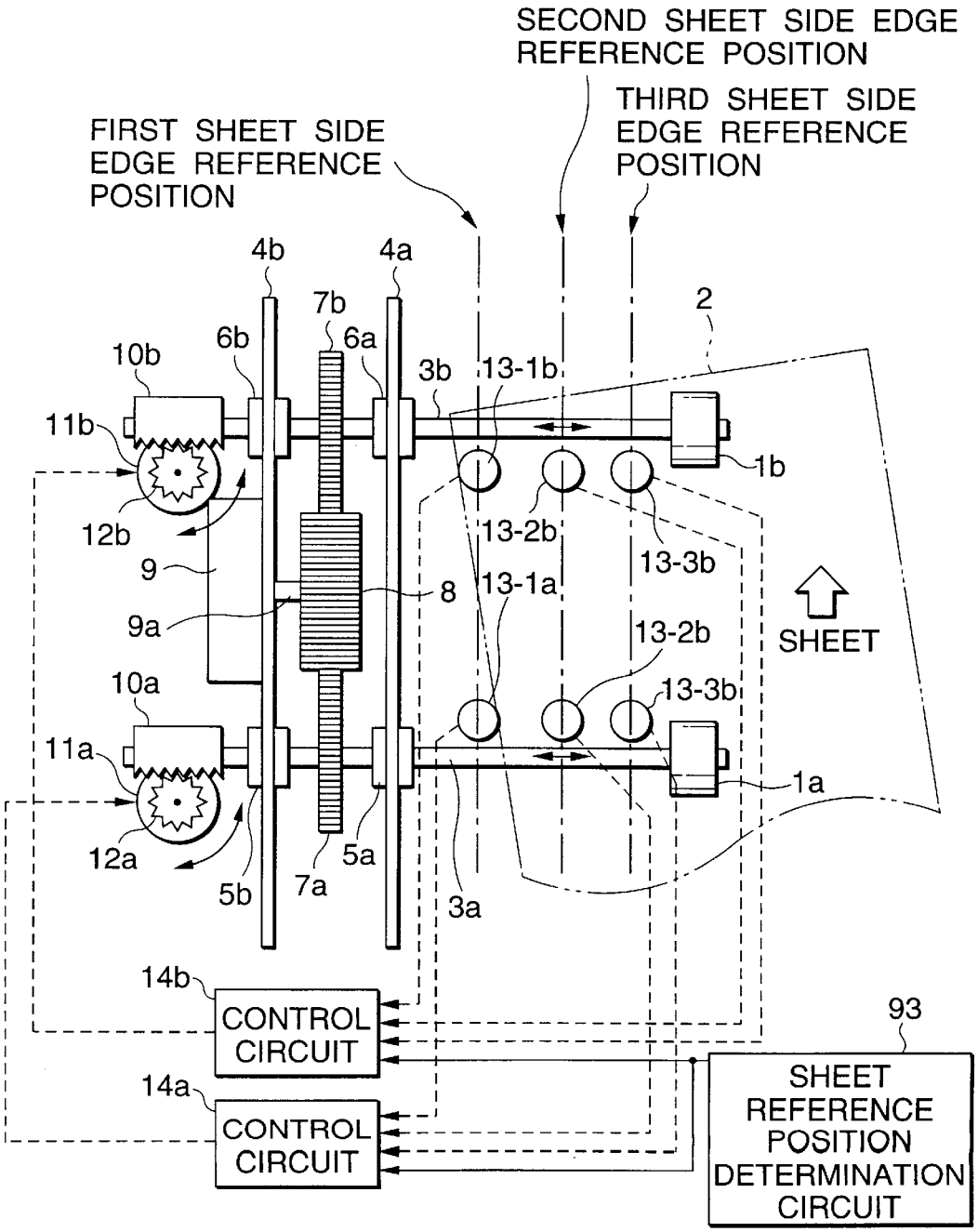
FIG. 12 is a schematic representation showing the configuration of a sheet alignment device according to a seventh embodiment of the present invention.

FIG. 12 is a schematic representation showing a sheet alignment device according to a seventh embodiment of the present invention. The sheet alignment device according to the present embodiment is basically the same as that used in the first embodiment. In the drawing, the elements which are the same as those shown in FIG. 1 are assigned the same reference numerals. The present embodiment is different from the first embodiment in that three sheet sensors 13-1*a*, 13-1*b* to 13-3*a*, 13-3*b* are provided at; e.g., first to third sheet side edge positions corresponding to the size of the sheet 2, and the control circuits 14*a*, 14*b* are arranged so as to control the direction in which the shift motors 11*a*, 11*b* are rotated through use of a sensor output corresponding to the determination information received from a sheet reference position determination circuit 93.

More specifically, the sheet reference position determination circuit 93 determines the sheet side edge reference position of the sheet 2 on the basis of information about a sheet size and a job input from the outside, the determination information is supplied to the control circuits 14*a*, 14*b*. The control circuits 14*a*, 14*b* control the direction in which the shift motors 11*a*, 11*b* are rotated through use of the detection output signal corresponding to the determination information from the sheet reference position determination circuit 93 from among the detection output signals from the three sheet sensors 13-1*a*, 13-1*b* to 13-3*a*, 13-3*b*.

As a result, with reference to one of the three sheet sensors 13-1*a*, 13-1*b* to 13-3*a*, 13-3*b*, skew and side misregistration of a sheet are corrected through the processing analogous to that performed in the first embodiment. As a result, the skew and side misregistration of the sheet 2 are corrected while the sheet 2 is being conveyed. Further, the sheet 2 is conveyed while being maintained at the center of a conveyance path regardless of the size of the sheet.

As mentioned previously, in the sheet alignment device according to a seventh embodiment, the sheet detection means are provided in a plurality of sheet side edge reference positions, and the rotation of the sheet is controlled while the sheet is being conveyed, on the basis of the result of detection by the sheet detection means which corresponds to the size of the sheet being conveyed. As a result, even in the sheet alignment device which conveys a sheet of each size while it is maintained in the center of a conveyance path, skew and side misregistration of a sheet can be corrected.

The three sheet sensors 13-1*a*, 13-1*b* to 13-3*a*, 13-3*b* may be formed independently of each other. Alternatively, the sheet sensors formed into a unit integrally comprising sensors 13-1*a*, 13-2*a*, 13-3*a* and a unit integrally comprising sensors 13-1*b*, 13-2*b*, 13-3*b*. For example, a CCD line sensor may be used for the sheet sensor. In a case where a CCD line sensor is used, pixel information corresponding to the first to third side edge reference positions is used. Further, the sheet sensors 13*a*, 13*b* of one system may be arranged so as to be movable in a direction intersecting the direction of conveyance, and the positions of the sheet sensors are set so as to correspond to the size of the sheet on the basis of the determination information from the sheet reference position determination circuit 93.

Although the seventh embodiment has been described with reference to the sheet alignment device configured on the basis of the first embodiment, the sheet alignment device according to the seventh embodiment can also be configured on the basis of the sheet alignment device according to any one of the second, third, and fourth embodiments.

Figure 13:
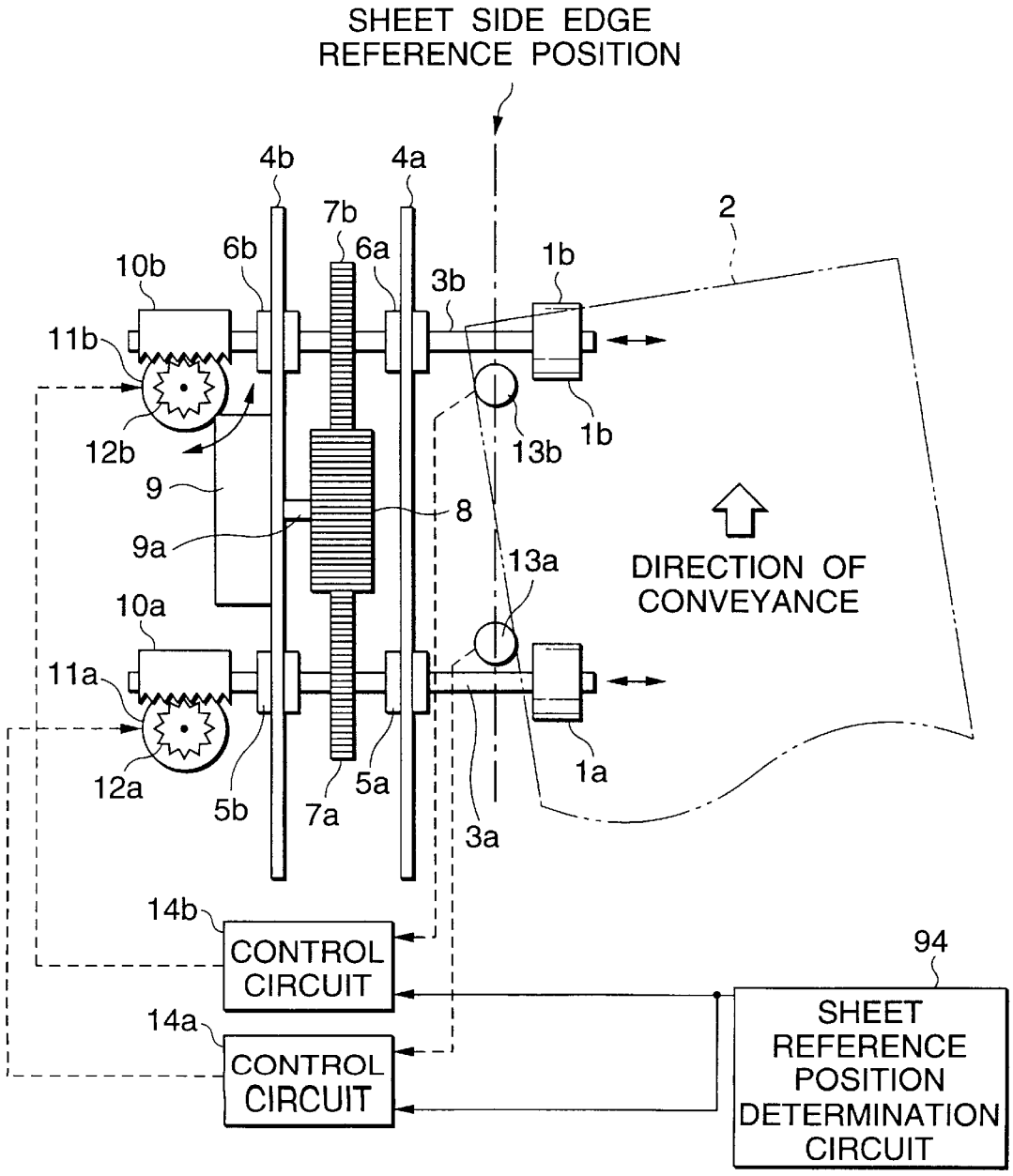
FIG. 13 is a schematic representation showing the configuration of a sheet alignment device according to an eighth embodiment of the present invention.

FIG. 13 is a schematic representation showing a sheet alignment device according to an eighth embodiment of the present invention. The sheet alignment device according to the present embodiment is basically the same as that used in the first embodiment. In the drawing, the elements which are the same as those shown in FIG. 1 are assigned the same reference numerals. In the seventh embodiment, the three sheet sensors 13-1*a*,13-1*b* to 13-3*a*, 13-3*b* are provided at; e.g., first to third sheet side edge positions corresponding to the size of the sheet 2.

In the eighth embodiment, in consideration of the fact that the sheet shift means which shifts the sheet 2 when the shift motors 11*a*, 11*b* are driven in the same direction is constituted of the conveyor rollers 1*a*, 1*b*, the rotary shafts 3*a*, 3*b*, the gears 10*a*, 10*b*, the shift motors 11*a*, 11*b*, the gears 12*a*, 12*b*, and their peripheral members, the sheet 2, whose skew and side misregistration have been corrected, is shifted to the position corresponding to the size of the sheet through use of the foregoing sheet shift means.

More specifically, the control circuits 14*a*,14*b* perform processing for the purpose of correcting the skew and side misregistration of the sheet 2 being conveyed, on the basis of the detection result signals from the sheet sensors 13*a*, 13*b* until the sheet 2 reaches a certain point in a path between the current step and the next step, as in the first embodiment. Subsequently, the control circuits 14*a*, 14*b* control the direction in which the shift motors 11*a*, 11*b* are rotated and the extent to which the shift motors 11*a*, 11*b* are rotated (i.e., the direction in which the sheet 2 is rotated and the extent to which the sheet 2 is moved) on the basis of the determination information from the sheet reference position determination circuit 94 in order to shift the sheet 2 to the position corresponding to the size of the sheet.

The sheet reference position determination circuit 94 determines the sheet side edge reference position for the sheet 2 being conveyed on the basis of the information about the size of the sheet and a job input from the outside, as does the sheet reference position determination circuit 93 according to the seventh embodiment. The information about the determination is supplied to the control circuits 14*a*, 14*b*.

As mentioned previously, in the sheet alignment device according to the eighth embodiment, the sheet which is being conveyed and has been subjected correction of skew and side misregistration is shifted to a position corresponding to the size of the sheet in a direction intersecting the direction of conveyance through use of the sheet shift means. As a result, even in a sheet alignment device which is configured so as to convey a sheet of each size while the sheet is held in the center of a conveyance path, skew and side misregistration of a sheet can be corrected. Further, the sheet alignment device requires only one system of sheet detection means and, hence, can be formed more inexpensively than the sheet alignment device according to the seventh embodiment.

In the present embodiment, although the explanation has been given of the sheet alignment device configured on the basis of the sheet alignment device according to the first embodiment, the sheet alignment device having the same configuration can also be formed on the basis of the sheet alignment device according to the third embodiment.

An explanation will be given of examples of the layout of the sheet alignment device within the image forming apparatus comprising any one of the sheet alignment devices according to the first to eight embodiments.

Figure 14A:
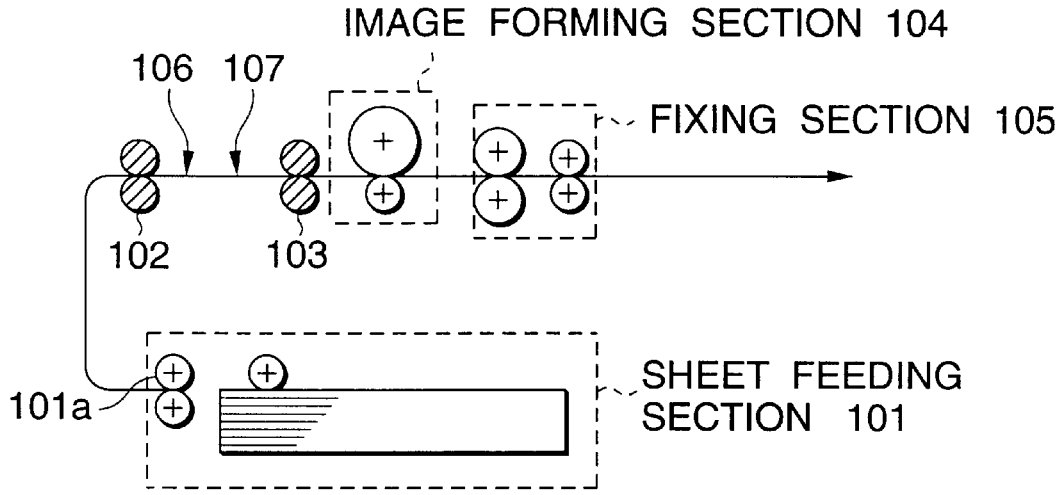
FIGS. 14A and 14B are schematic representation showing an example of layout (1) of the sheet alignment device.
Figure 14B:
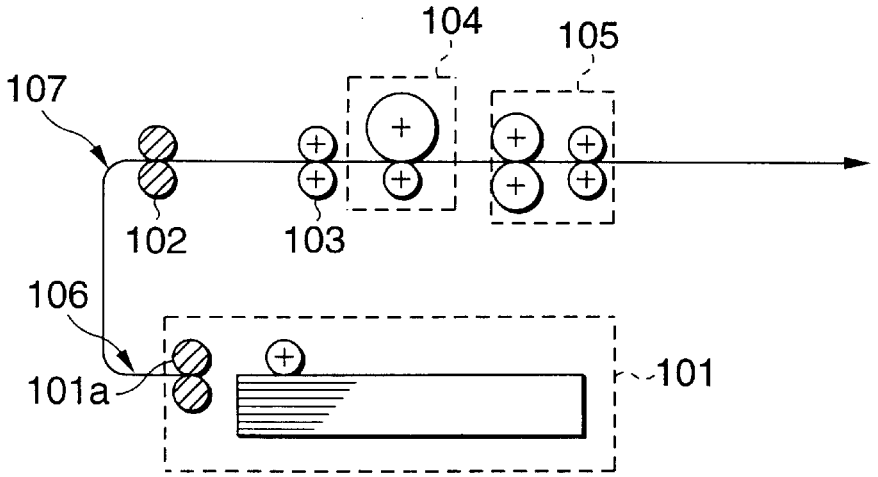

FIGS. 14A and 14B show an example of layout of; e.g., the sheet alignment device according to the first embodiment, within an image forming apparatus capable of forming an image only on one side of a sheet. In FIGS. 14A and 14B, a sheet fed from a sheet feeding section 101 by means of a sheet feed roller 101*a* is conveyed to an image forming section 104 by means of conveyor rollers 102, 103. An image is formed on the sheet in the image forming section 104, and the sheet is supplied to a fixing section 105, where the image is fixed. The sheet is then fed to another step.

In the example of layout shown in FIG. 14A, the conveyor rollers 102, 103 of the image forming apparatus having the foregoing configuration are also used as conveyor rollers of the sheet alignment device. The sheet alignment device according to the first embodiment is disposed on a conveyance path immediately before the image forming section 104. In FIG. 14A, the conveyor rollers 102, 103 correspond to the conveyor rollers 1*a*, 1*b* employed in the first embodiment. Sheet sensors 106, 107 correspond to the sheet sensors 13*a*, 13*b* according to the first embodiment (see FIG. 1).

In the example of layout shown in FIG. 14B, the sheet feed roller 101*a* of the sheet feeding section 101 and the conveyor roller 102 double as the conveyor rollers of the sheet alignment device. The sheet alignment according to the first embodiment is positioned on the conveyance path immediately behind the sheet feeding section 101. In FIG. 14B, the sheet feed roller 101*a* and the conveyor roller 102 correspond to the conveyor rollers 1*a*, 1*b* employed in the first embodiment. Further, the sheet sensors 106, 107 correspond to the sheet sensors 13*a*, 13*b* according to the first embodiment (see FIG. 1).

Although the example of layout of the sheet alignment device according to the first embodiment is shown in FIGS. 14A and 14B, the sheet alignment devices according to the second, fifth, seventh, and eight embodiments can be arranged in the same manner. In another example of layout, the sheet alignment device is disposed in an upstream position with reference to an original reading section within an original feeding unit or in an upstream position with reference to a perforating section within a post-processing unit.

Figure 15A:
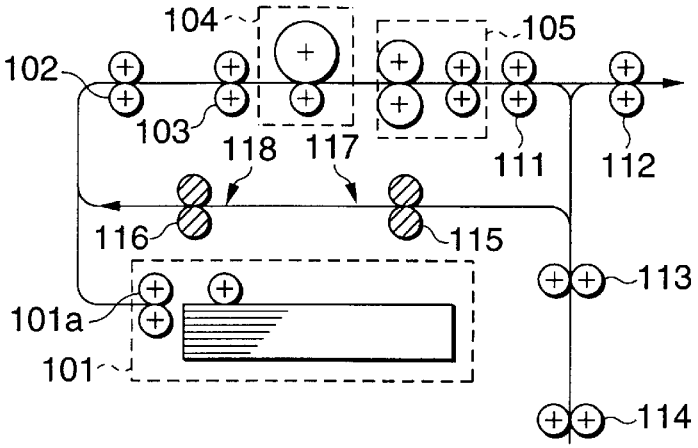
FIGS. 15A to 15C are schematic representation showing an example of layout (2) of the sheet alignment device.
Figure 15B:
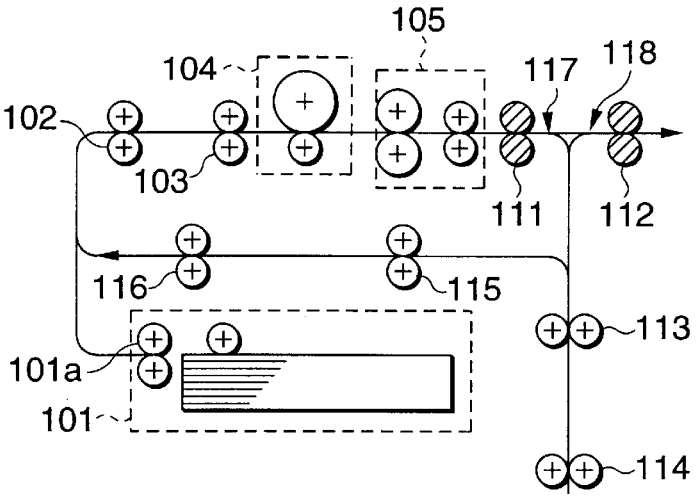
Figure 15C:
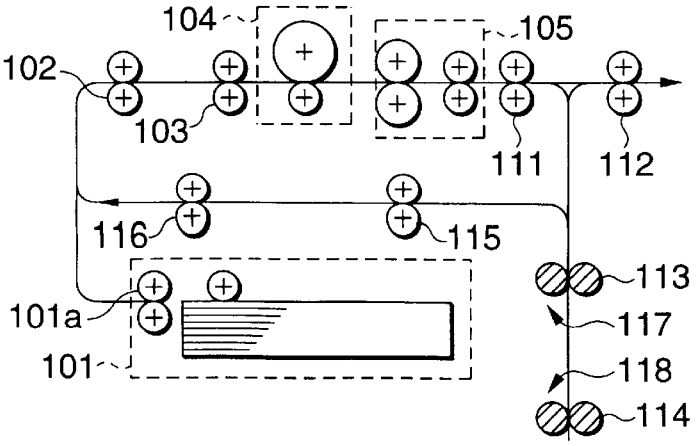

FIGS. 15A, 15B, and 15C show an example of layout of; e.g., the sheet alignment device according to the first embodiment, within an image forming apparatus capable of forming an image on each side of a sheet. In FIGS. 15A, 15B, and 15C, the sheet fed from the sheet feeding section 101 by means of the sheet feed roller 101*a* is conveyed to the image forming section 104 by means of conveyor rollers 102, 103. Images are formed on the sheet in the image forming section 104, and the sheet is supplied to the fixing section 105, where the images are fixed. In a case where a single image is formed, the sheet is fed to another step by means of discharge conveyor rollers 111, 112. In a case where an image is formed on each side of the sheet, the sheet is fed to reverse rollers 113, 114 by means of the discharge conveyor roller 111, where the sheet is inverted by the reverse rollers 113, 114. The thus-inverted sheet is again fed to the conveyor rollers 102, 103 by means of double-sided printing conveyor rollers 115, 116.

In the example of layout shown in FIG. 15A, the double-sided printing conveyor rollers 115, 116 of the image forming apparatus having the foregoing configuration are also used as conveyor rollers of the sheet alignment device. The sheet alignment device according to the first embodiment is disposed on the path along which the inverted sheet is fed. In FIG. 15A, the double-sided printing conveyor rollers 115, 116 correspond to the conveyor rollers 1*a*, 1*b* employed in the first embodiment. Sheet sensors 117, 118 correspond to the sheet sensors 13*a*, 13*b* according to the first embodiment (see FIG. 1).

In the example of layout shown in FIG. 15B, the discharge conveyor rollers 111, 112 double as the conveyor rollers of the sheet alignment device. The sheet alignment according to the first embodiment is positioned on the conveyance path immediately behind the fixing section 105. In FIG. 15B, the discharge conveyor rollers 111, 112 correspond to the conveyor rollers 1*a*, 1*b* employed in the first embodiment. Further, the sheet sensors 117, 118 correspond to the sheet sensors 13*a*, 13*b* according to the first embodiment (see FIG. 1).

In the example of layout shown in FIG. 15C, the reverse rollers 113, 114 double as the conveyor rollers of the sheet alignment device. The sheet alignment according to the first embodiment is positioned on the path along which the inverted sheet is fed. In FIG. 15C, the reverse rollers 113, 114 correspond to the conveyor rollers 1*a*, 1*b* employed in the first embodiment. Further, the sheet sensors 117, 118 correspond to the sheet sensors 13*a*, 13*b* according to the first embodiment (see FIG. 1).

Although the example of layout of the sheet alignment device according to the first embodiment is shown in FIGS. 15A, 15B, and 15C, the sheet alignment devices according to the second, fifth, seventh, and eight embodiments can be arranged in the same manner. In another example of layout, the sheet alignment device is disposed in an upstream position with reference to an original reading section within an original feeding unit or in an upstream position with reference to a perforating section within a post-processing unit.

Figure 16A:
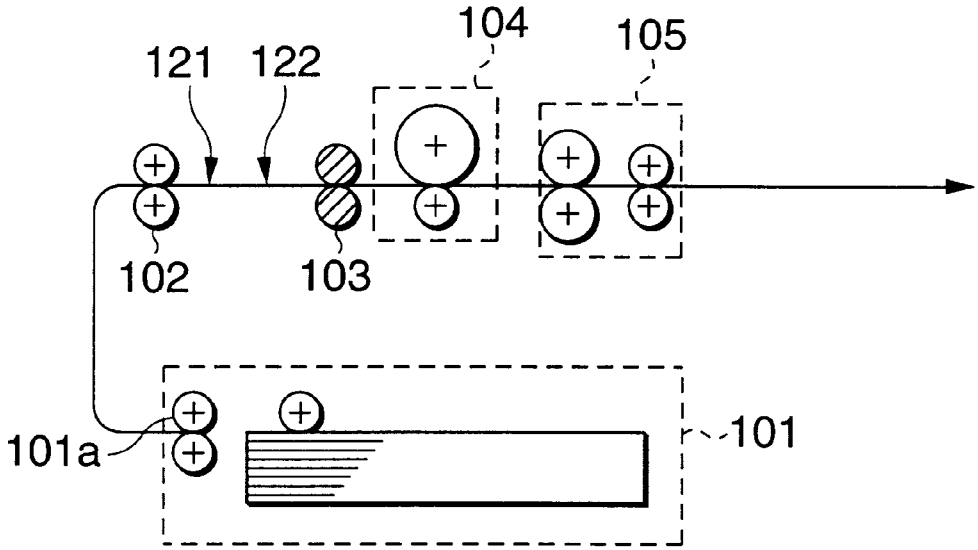
FIGS. 16A and 16B are schematic representation showing an example of layout (3) of the sheet alignment device.
Figure 16B:
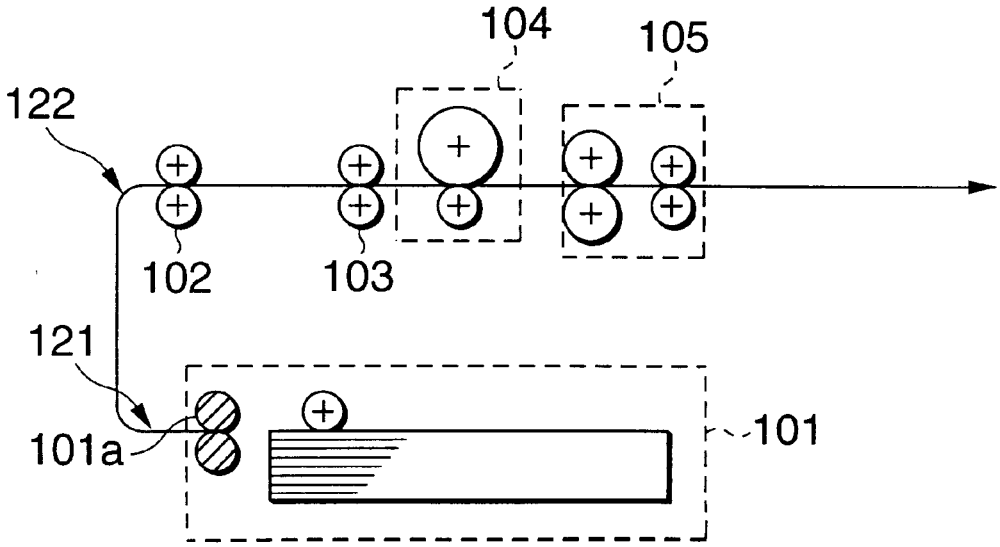

FIGS. 16A and 16B show an example of layout of; e.g., the sheet alignment device according to the third embodiment, within an image forming apparatus capable of forming an image only on one side of a sheet. In the example of layout shown in FIG. 16A, the conveyor roller 103 is also used as a conveyor roller of the sheet alignment device. The sheet alignment device according to the third embodiment is disposed on the conveyance path immediately before the image forming section 102. In FIG. 16A, the conveyor roller 103 corresponds to the conveyor rollers 41*a*, 41*b* employed in the third embodiment. Sheet sensors 121, 122 correspond to the sheet sensors 53*a*, 53*b* according to the third embodiment (see FIG. 5).

In the example of layout shown in FIG. 16B, the sheet feed roller 101*a* of the sheet feeding section 101 doubles as the conveyor roller of the sheet alignment device. The sheet alignment according to the third embodiment is positioned on the conveyance path immediately behind the sheet feeding section 101. In FIG. 16B, the sheet feed roller 101*a* corresponds to the conveyor rollers 41*a*, 41*b* employed in the third embodiment. Further, the sheet sensors 121, 122 correspond to the sheet sensors 53*a*, 53*b* according to the third embodiment (see FIG. 5).

Although the example of layout of the sheet alignment device according to the third embodiment is shown in FIGS. 16A and 16B, the sheet alignment devices according to the fourth and sixth embodiments can be arranged in the same manner. In another example of layout, the sheet alignment device is disposed in an upstream position with reference to an original reading section within an original feeding unit or in an upstream position with reference to a perforating section within a post-processing unit.

Figure 17A:
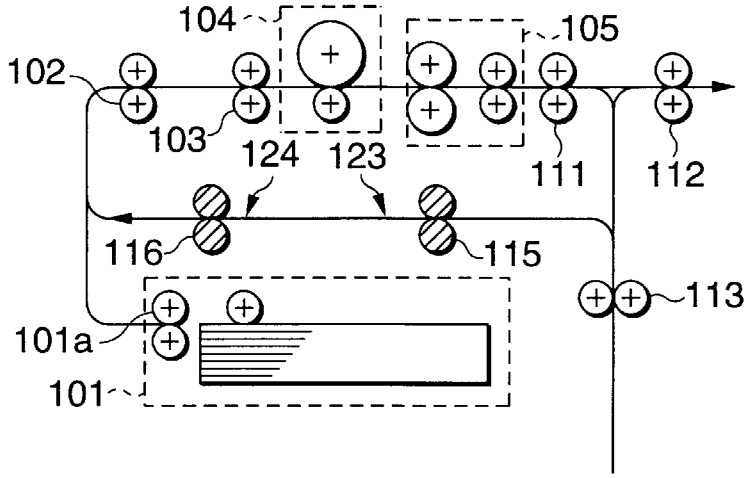
FIGS. 17A to 17C are schematic representation showing an example of layout (4) of the sheet alignment device.
Figure 17B:
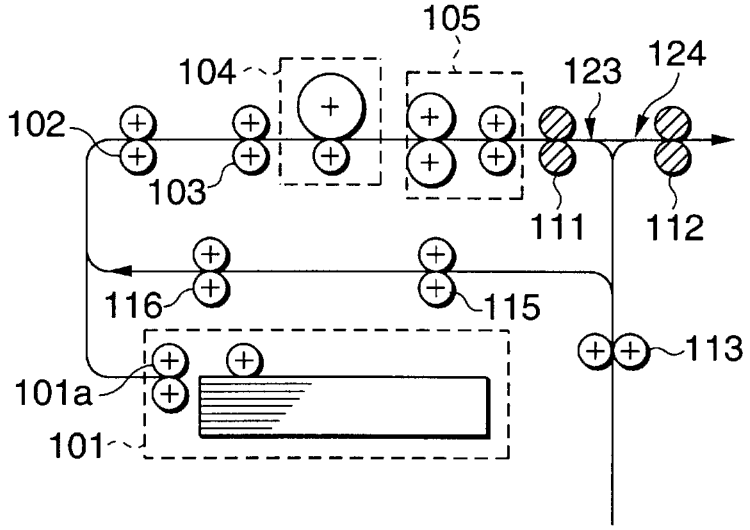
Figure 17C:
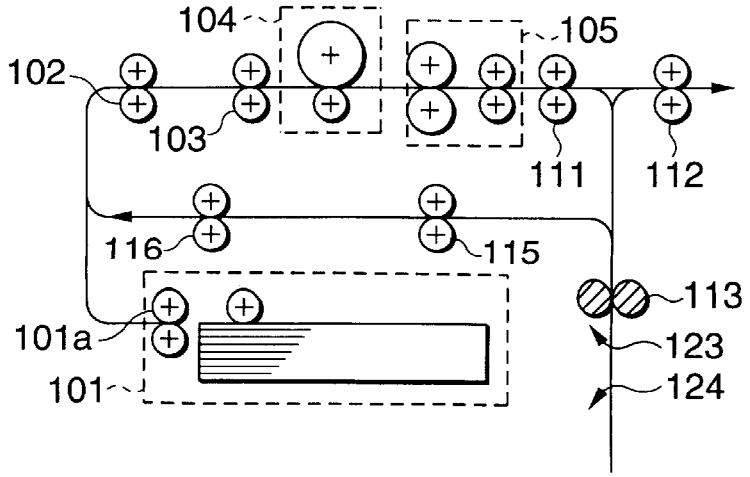

FIGS. 17A, 17B, and 17C show an example of layout of; e.g., the sheet alignment device according to the third embodiment, within an image forming apparatus capable of forming an image on each side of a sheet. In the example of layout shown in FIG. 17A, the double-sided printing conveyor roller 116 of the image forming apparatus having the foregoing configuration is also used as a conveyor roller of the sheet alignment device. The sheet alignment device according to the third embodiment is disposed on the path along which the inverted sheet is fed. In FIG. 17A, the double-sided printing conveyor roller 116 corresponds to the conveyor rollers 41*a*, 41*b* employed in the third embodiment. Sheet sensors 123, 124 correspond to the sheet sensors 53*a*, 53*b* according to the third embodiment (see FIG. 5).

In the example of layout shown in FIG. 17B, the discharge conveyor roller 112 doubles as the conveyor roller of the sheet alignment device. The sheet alignment according to the third embodiment is positioned on the conveyance path immediately behind the fixing section 105. In FIG. 17B, the discharge conveyor roller 112 corresponds to the conveyor rollers 41*a*, 41*b* employed in the third embodiment. Further, the sheet sensors 123, 124 correspond to the sheet sensors 53*a*, 53*b* according to the third embodiment (see FIG. 5).

In the example of layout shown in FIG. 17C, the reverse roller 113 doubles as the conveyor roller of the sheet alignment device. The sheet alignment according to the third embodiment is positioned on the path along which the inverted sheet is fed. In FIG. 17C, the reverse roller 113 corresponds to the conveyor rollers 41*a*, 41*b* employed in the third embodiment. Further, the sheet sensors 123, 124 correspond to the sheet sensors 53*a*, 53*b* according to the third embodiment (see FIG. 5).

Although the example of layout of the sheet alignment device according to the third embodiment is shown in FIGS. 17A, 17B, and 17C, the sheet alignment devices according to the fourth and sixth embodiments can be arranged in the same manner. In another example of layout, the sheet alignment device is disposed in an upstream position with reference to an original reading section within an original feeding unit or in an upstream position with reference to a perforating section within a post-processing unit.

In the image forming apparatus which has any one of the foregoing layout examples, the control circuit of the sheet alignment device in each of the embodiments controls the sheet so as to be subjected to correction of skew and side misregistration while the sheet is being conveyed. The control circuit controls the sheet rotation means and the sheet shift means so as to finish rotating and shifting the sheet at a certain position before the sheet arrives at a printing section (not shown). With these arrangements, the sheet alignment can be prevented from aligning a sheet which arrives at the printing section provided in a downstream position with reference to the sheet alignment device or a sheet the printing of which is commenced by the printing section. Accordingly, a printing operation can be smoothly performed.

In the image forming apparatus which has any one of the foregoing layout examples, the control circuit of the sheet alignment device in each of the embodiments controls the sheet so as to be subjected to correction of skew and side misregistration while the sheet is being conveyed. The control circuit controls the sheet rotation means and the sheet shift means so as to finish rotating and shifting the sheet at a certain position before the sheet arrives at the sheet shift means, such as conveyor rollers, which are placed in a downstream position with reference to the sheet alignment device and axially move within a limited extent. With these arrangements, the sheet alignment can be prevented from aligning a sheet which arrives at the sheet conveyor means provided in a downstream position with reference to the sheet alignment device and cannot be rotated or shifted. Accordingly, the aligned sheet can be smoothly conveyed while the state of the sheet is maintained.

In any one of the cases, several methods are conceivable. Under one method, a sheet sensor is placed in a predetermined location in order to detect the arrival of a sheet being conveyed to the predetermined location. A detection output signal from the sheet sensor is used. Under another method, provided that the speed at which the sheet is conveyed is known, a sensor provided in the vicinity of a sheet feed roller of a sheet feeding section, for example, commences counting time from when the feeding of a sheet is detected. It is determined whether or not the thus-determined time reaches a conveyance time which is calculated from the conveyance speed of the sheet and is required by the sheet to arrive at the predetermined location.

As has been described above, a sheet alignment apparatus according to the present invention has sheet side edge detection means for detecting the side edges of a sheet disposed on the sheet transport path. The sheet being conveyed is rotated in the direction determined by the result of detection. As a result, the skew and side misregistration of the sheet can be simultaneously corrected. Further, since the skew and side misregistration of the sheet are constantly corrected, the performance of the sheet alignment device is not affected even if conveyor rollers become abraded.

Another sheet alignment device according to the present invention comprises sheet side edge detection means for detecting the side edges of a sheet disposed on the sheet transport path; and sheet shift means which rotates in the direction determined by the result of detection and shifts the sheet in a direction intersecting the direction of conveyance. With this arrangement, the skew and side misregistration of the sheet can be simultaneously corrected. In addition, even if the conveyor rollers become abraded, the performance of the sheet alignment device is not affected, because the skew and side misregistration of the sheet are constantly corrected. If the sheet being conveyed is greatly displaced from the sheet side edge detection means, it becomes possible for the sheet alignment device to immediately start correcting the skew and side misregistration of the sheet by moving the sheet in parallel with the direction of conveyance through use of the paper shift means.

In any one of the foregoing sheet alignment devices, since the side edges of the sheet are brought into alignment with the reference position, a deviation is prevented from arising between an image formed on a first surface and another image formed on a second surface during a double-sided printing operation. Further, since the sheet is not brought into contact with a reference wall, the performance of the sheet alignment device is not affected by the thickness or rigidity of the sheet, nor is a sound of collision produced. Further, since the sheet is not suspended, high productivity is achieved. Still further, correcting the skew and side misregistration of the sheet doe not require any arithmetic operation, and therefore the sheet alignment device can be controlled through use of a simple switching circuit, thereby rendering the sheet alignment device inexpensive.

What is claimed is:

1. A sheet alignment device comprising:

first and second sheet conveyor means for conveying a sheet, said first and second sheet conveyor means being disposed in different positions in a direction of sheet conveyance and imparting conveying force to the sheet;

sheet rotation means for rotating the sheet;

sheet side edge detection means for detecting a side edge of the sheet while the sheet is conveyed by said first and second sheet conveyor means; and control means for controlling a direction in which said sheet rotation means rotates, on the basis of the result of detection by said sheet edge detection means, wherein said sheet rotation means and said first and second sheet conveyor means include shift means for axially shifting one of said first and second sheet conveyor means in a direction intersecting the direction in which the sheet is conveyed; and control means for controlling a direction in which said shift means moves said first and second sheet conveyor means, on the basis of the result of detection by said sheet side edge detection means.

2. The sheet alignment device of claim 1, wherein said shift means comprises:

single shift means which shifts in the direction intersecting the direction of conveyance of said first sheet conveyor means and said second sheet conveyor means, whichever is positioned in a rearward position in the direction of conveyance;

said sheet side edge detection means comprises;

single detection means which is located in one position in the direction of conveyance; and said control means for controlling the direction in which said single shift means moves said sheet conveyor means controls on the basis of the result of detection by said single detection means.

3. The sheet alignment device of claim 1, wherein said sheet rotation means comprises:

said first and second sheet conveyor means which are disposed in different positions in a direction intersecting the direction of conveyance and independently impart conveying speed to the sheet; and said control means for individually controlling the conveying speed of said first and said second sheet conveyor means on the basis of the result of detection by said sheet side edge detection means.

4. The sheet alignment device of claim 3, wherein said sheet side edge detection means comprises:

single detection means disposed in the vicinity of one of said first and said second sheet conveyance means; and control means for controlling the conveying speed of said first and said second sheet conveyor means does so on the basis of the result of detection of said single detection means.

5. The sheet alignment device of claim 1, further comprising:

sheet leading edge detection means which is disposed in a forward position in relation to said sheet conveyor means in the direction of conveyance, and detects the leading edge of the sheet conveyed by said sheet conveyance means; wherein a control means switches the rotational speed of said sheet rotation means between a high-speed mode and a low-speed mode on the basis of the result of detection by said sheet leading edge detection means during the control operation based on the result of detection by said sheet side edge detection means.

6. The sheet alignment device of claim 1, wherein said sheet side edge detection means are provided in several positions in the direction intersecting the direction of conveyance.

7. The sheet alignment device of claim 1, wherein said sheet side edge detection means is capable to be moved in the direction intersecting the direction of conveyance.

8. An image forming apparatus comprising:

said sheet alignment device of claim 1.

9. The image forming apparatus of claim 8, wherein said sheet alignment device is disposed in an upstream position in relation to a printing section.

10. The image forming apparatus of claim 8, wherein a control means controls said sheet rotation means so as to finish rotating the sheet, and said sheet shift means so as to finish shifting the sheet before the sheet arrives at the printing section.

11. The image forming apparatus of claim 8, wherein said sheet alignment device is disposed along a transport path used for the purpose of double-sided printing.

12. A sheet alignment device comprising:

sheet conveyor means for conveying a sheet;

sheet rotation means for rotating the sheet;

sheet shift means for axially shifting the sheet in a direction intersecting the direction of conveyance by axially shifting the sheet conveyor means;

side edge detection means for detecting a side edge of the sheet while the sheet is being conveyed by said sheet conveyor means; and control means for controlling a direction in which said sheet rotation means rotates the sheet and a direction in which said sheet shift means shifts the sheet, on the basis of the result of detection by said sheet side edge detection means.

13. The sheet alignment device of claim 12, wherein said sheet side edge detection means comprises:

a first and a second detection means positioned in different locations in the direction of conveyance; and said control means controls the directions of rotation and shift on the basis of the result of detection by said respective first and second detection means.

14. The sheet alignment device of claim 12, wherein said sheet conveyor means, said sheet rotation means, and said sheet shift means comprise:

a first and a second sheet conveyor means which are disposed in different locations in the direction of conveyance and respectively impart conveying force to the sheet, and a first and a second shift means for axially shifting said first and said second sheet conveyor means independently of each other in a direction intersecting the direction of conveyance; and said control means controls, on the basis of the result of said sheet side edge detection means, said first and said second shift means so as to axially shift said first and said second sheet conveyor means in opposite directions when the sheet is rotated, and in the same direction when the sheet is shifted.

15. The sheet alignment device of claim 12, wherein said sheet conveyor means, said sheet rotation means, and said sheet shift means comprise:

a first and a second sheet conveyor means which are placed in different locations in the direction of conveyance and independently impart conveying force to the sheet, and a first and a second sheet shift means which shift said first and said second sheet conveyor means independently of each other in a direction intersecting the direction of conveyance; and said control means controls, on the basis of the result of said sheet side edge detection means, the conveying speed of said first and said second sheet conveyor means individually when the sheet is rotated, and said shift means when the sheet is shifted.

16. The sheet alignment device of claim 12, further comprising:

sheet leading edge detection means which is disposed in a forward position in relation to said sheet conveyor means in the direction of conveyance and detects the leading edge of the sheet conveyed by said sheet conveyance means; wherein said control means switches the shifting speed of said sheet shift means between a high-speed mode and a low-speed mode on the basis of the result of detection by said sheet leading edge detection means during the control operation based on the result of detection by said sheet side edge detection means.

17. The sheet alignment device of claim 12, further comprising:

sheet reference position determination means for determining a given reference position; wherein said control means controls, on the basis of information about the decision made by said sheet reference position determination means, the direction in which and the extent to which said sheet shift means shifts the sheet.

18. An image forming apparatus comprising said sheet alignment device of claim 12, wherein a control means controls said sheet rotation means so as to finish rotating the sheet, and controls said sheet shift means so as to finish shifting the sheet, before the sheet arrives at a second sheet conveyor means which is disposed in a downward position in relation to said sheet alignment device.

19. A sheet alignment device comprising:

first and second sheet conveyor means for conveying a sheet, said first and second sheet conveyor means being disposed in different locations in a direction of conveyance of the sheet and respectively impart conveying force to the sheet;

sheet rotation means for rotating the sheet;

first and second shift means for shifting said first and said second sheet conveyor means independently of each other in a direction intersecting the direction of conveyance;

sheet shift means for shifting the sheet in a direction intersecting the direction of conveyance;

side edge detection means for detecting a side edge of the sheet while the sheet is being conveyed by said first and second sheet conveyor means;

control means for controlling a direction in which said sheet rotation means rotates the sheet and a direction in which said sheet shift means shifts the sheet, on the basis of the result of detection by said sheet side edge detection means, said control means controlling said first and second shift means so as to shift said first and said second sheet conveyor means in opposite directions when the sheet is rotated, and in a same direction when the sheet is shifted.

* * * * *